US006668808B2

(12) United States Patent
Tagami et al.

(10) Patent No.: US 6,668,808 B2
(45) Date of Patent: Dec. 30, 2003

(54) CONTROLLER FOR CONTROLLING AN EVAPORATED FUEL AMOUNT TO BE PURGED

(75) Inventors: Takeshi Tagami, Wako (JP); Kota Ikeuchi, Wako (JP); Koichi Hidano, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 59 days.

(21) Appl. No.: 10/150,496

(22) Filed: May 20, 2002

(65) Prior Publication Data

US 2002/0174856 A1 Nov. 28, 2002

(30) Foreign Application Priority Data

May 22, 2001 (JP) ..... 2001-151979

(51) Int. Cl.[7] ..... F02M 33/04
(52) U.S. Cl. ..... 123/520; 123/698
(58) Field of Search ..... 123/519, 520, 123/698

(56) References Cited

U.S. PATENT DOCUMENTS

| | | | | |
|---|---|---|---|---|
| 5,680,849 | A * | 10/1997 | Morikawa et al. | 123/520 |
| 6,343,467 | B1 * | 2/2002 | Muto et al. | 123/520 |
| 6,505,599 | B1 * | 1/2003 | Mashiki et al. | 123/520 |
| 2001/0003979 | A1 * | 6/2001 | Oki et al. | 123/520 |
| 2003/0005916 | A1 * | 1/2003 | Osanai | 123/520 |
| 2003/0154963 | A1 * | 8/2003 | Furushou | 123/520 |

FOREIGN PATENT DOCUMENTS

| | | |
|---|---|---|
| JP | 7-3211 | 1/1995 |
| JP | 08-074684 | 3/1996 |
| JP | 08-082236 | 3/1996 |
| JP | 9-105347 | 4/1997 |
| JP | 11-264351 | 9/1999 |
| JP | 2000-310162 | 11/2000 |

* cited by examiner

*Primary Examiner*—Thomas N. Moulis
(74) *Attorney, Agent, or Firm*—Arent Fox Kintner Plotkin & Kahn

(57) ABSTRACT

An evaporated fuel controller for an internal-combustion engine comprises a purge system for purging evaporated fuel generated inside a fuel tank to an intake system of the engine. The controller determines a guard value in accordance with driving conditions of the engine. The guard value is an upper limit of the evaporated fuel. The purge control valve is controlled to prevent the amount of the evaporated fuel from exceeding the guard value. Thus, the amount of the evaporated fuel is controlled so that influence on the air-fuel ratio control is minimized. In one embodiment, the controller further determines a transport lag of the evaporated fuel between the purge control valve and the engine. The controller determines an evaporated fuel amount purged a time period earlier, the time period corresponding to the transport lag. The purge control valve is controlled to prevent the amount of the evaporated fuel from increasing if the evaporated fuel amount purged the time period earlier is close to the guard value.

20 Claims, 21 Drawing Sheets

CONTROLLER FOR CONTROLLING AN EVAPORATED FUEL AMOUNT TO BE PURGED

BACKGROUND OF THE INVENTION

The present invention relates to an evaporated fuel controller for controlling an amount of evaporated fuel to be purged to an intake system of the internal-combustion engine.

An internal-combustion engine of an automobile is supplied with fuel from a fuel tank through a fuel injection valve. The fuel injection valve is controlled so that the required amount of fuel to achieve a desired driving condition is supplied to the engine.

On the other hand, evaporated fuel generated inside the fuel tank is adsorbed in a canister. Some absorbed evaporated fuel is purged into an intake system through a purge control valve. The amount of the evaporated fuel flowing into the engine is controlled by adjusting an opening degree of the purge control valve in accordance with driving conditions.

In general, a feedback control for an air-fuel ratio of the engine is performed. The current air-fuel ratio is detected by an air-fuel ratio sensor. A feedback correction value for correcting a difference between the detected air-fuel ratio and a target air-fuel ratio is determined. The current fuel injection amount is corrected with the correction value so that the air-fuel ratio converges to the target air-fuel ratio. The fuel injection valve is controlled in accordance with the corrected fuel injection amount.

When the evaporated fuel is purged into the intake system of the engine, there may occur a variation in the air-fuel ratio. Moreover, there exists a delay in the air-fuel ratio feedback control because there is a time delay between a time at which the evaporated fuel is purged and a time at which the evaporated fuel reaches the engine. In order to achieve a higher accuracy of the air-fuel ratio feedback control, it is required to control the amount of the evaporated fuel that contributes to the fuel to be supplied to the engine.

Japanese Patent Application Unexamined Publication (Kokai) No. H9-105347 discloses a controller for restricting an amount of evaporated fuel to be purged when a ratio of the amount of the evaporated fuel to a required amount of fuel has exceeded a predetermined value.

Japanese Patent Application Examined Publication (Kokoku) No. H7-3211 discloses an evaporated fuel gas discharge prevention device for reducing the area of a passage for purging evaporated fuel when it is determined that an amount of fuel supply which is controlled by an air-fuel ratio feedback control has become less than a predetermined reference fuel supply amount.

As described above, a certain time period is required from the time at which evaporated fuel is purged into the intake system to the time at which the evaporated fuel reaches the engine. This time period is referred to as "transport lag". If the amount of evaporated fuel to be purged is restricted after the ratio of the evaporated fuel amount to the required fuel amount has exceeded a predetermined value as described in the conventional arts, the air-fuel ratio may be influenced by the residual evaporated fuel that is caused by the transport lag. As a result, an appropriate air-fuel ratio feedback control is not maintained.

Thus, there is a need for a controller and a method for controlling an amount of the evaporated fuel to be purged before the ratio of the evaporated fuel amount to the required fuel amount exceeds a predetermined value, thereby maintaining an appropriate air-fuel ratio feedback control.

SUMMARY OF THE INVENTION

According to one aspect of the invention, an evaporated fuel controller for an internal-combustion engine comprises a purge system for purging evaporated fuel generated inside a fuel tank to an intake system of the engine. The controller determines a guard value in accordance with driving conditions of the engine. The guard value is an upper limit of the evaporated fuel. The purge control valve is controlled to prevent an amount of the evaporated fuel from exceeding the guard value. Thus, the amount of the evaporated fuel is controlled without influence on the air-fuel ratio, thereby maintaining an appropriate air-fuel ratio feedback control.

According to one embodiment, the guard value is an upper limit of the evaporated fuel able to be included in required fuel to be supplied to the engine. Thus, the evaporated fuel is controlled so that the ratio of the evaporated fuel amount to the required fuel does not exceed a predetermined value.

According to another aspect of the invention, the controller further determines a transport lag of the evaporated fuel between the purge control valve and the engine. The controller determines an evaporated fuel amount purged a time period earlier, the time period corresponding to the transport lag. The purge control valve is controlled based on the evaporated fuel amount purged in the time period earlier. Because it is determined whether the amount of the evaporated fuel is approaching the guard value with consideration of the transport lag of the evaporated fuel, the evaporated fuel amount is surely prevented from exceeding the guard value. Therefore, more appropriate air-fuel ratio feedback is implemented.

According to one embodiment of the invention, the purge control valve is controlled to prevent the amount of the evaporated fuel from increasing if the evaporated fuel amount purged the time period earlier is close to the guard value. Thus, the increase of the evaporated fuel is stopped when the amount of the evaporated fuel approaches the guard value. The evaporated fuel is appropriately controlled without exceeding the guard value.

According to another aspect of the invention, the purge control valve is controlled so that a maximum amount of the evaporated fuel is purged to the intake system as long as the amount of the evaporated fuel does not exceed the guard value. Thus, the evaporated fuel is efficiently used for the engine while the appropriate air-fuel ratio feedback control is maintained.

According to another aspect of the invention, the evaporated fuel controller determines a density of the evaporated fuel. The amount of the evaporated fuel is determined based on the density of the evaporated fuel.

Thus, the amount of the evaporated fuel is correctly determined.

According to another aspect of the invention, the controller comprises a fuel supply system for supplying fuel from a fuel tank to the engine through a fuel injection valve. The controller further determines an amount of the required fuel in accordance with the driving conditions of the engine. The required fuel amount is corrected with a fuel correction amount corresponding to the amount of the evaporated fuel that is controlled not to exceed the guard value. The fuel injection valve is controlled to inject the corrected required fuel amount to the engine. Thus, the required fuel amount is appropriately corrected with the fuel correction amount, thereby preventing the air-fuel ratio from deteriorating.

DESCRIPTION OF THE PREFERRED EMBODIMENTS

Figure 1:
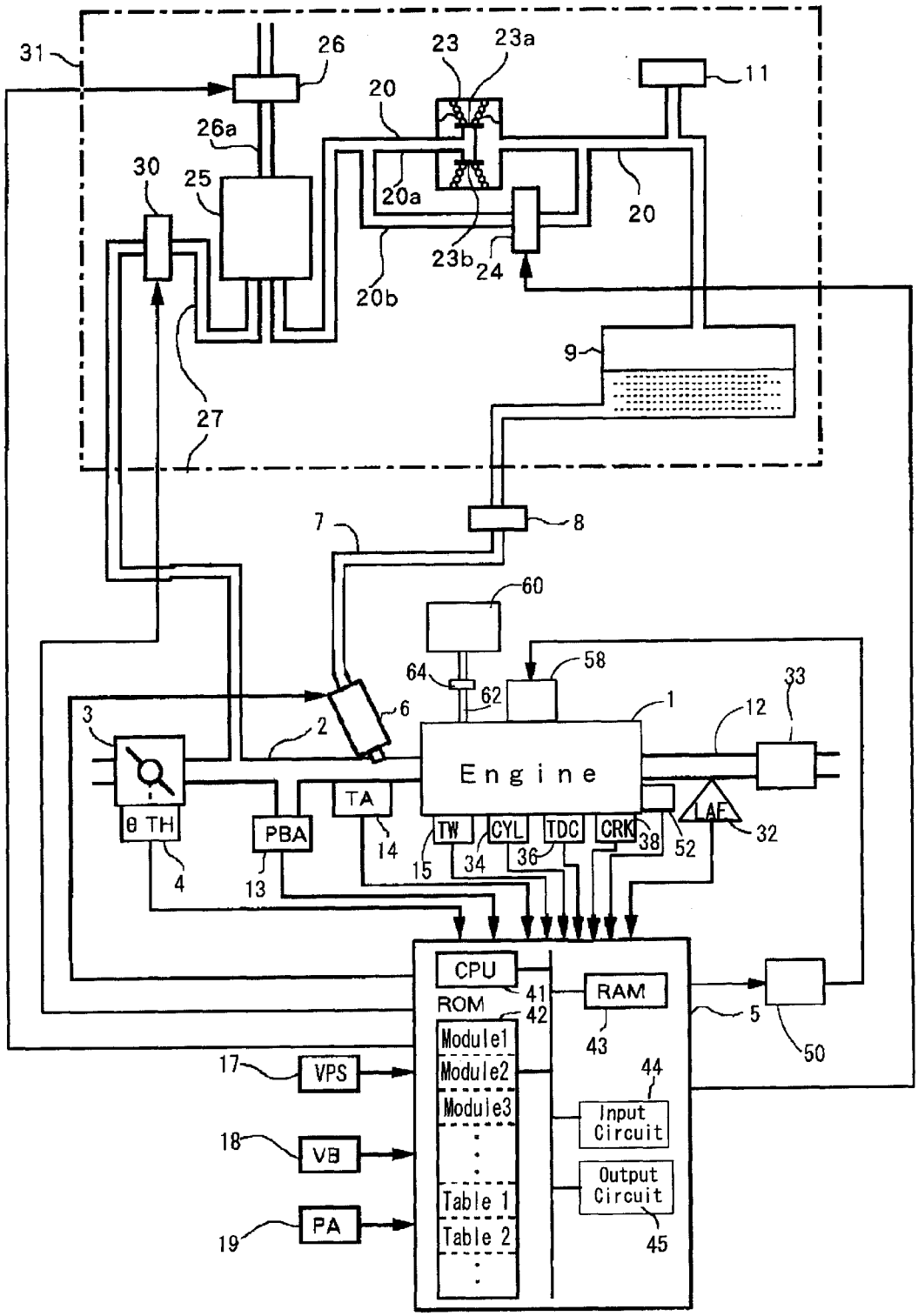
FIG. 1 is a block diagram showing a controller of internal-combustion engine according to one embodiment of the invention.

Referring now to the drawings, specific embodiments of the invention will be described. FIG. 1 is a block diagram showing a controller of an internal-combustion engine in accordance with the embodiment of the invention.

An electronic control unit (hereinafter referred to as ECU) 5 comprises CPU 41 for carrying out operations for controlling each part of the engine 1, a read only memory (ROM) 42 for storing programs and various data to control each part of the engine 1, a random access memory (RAM) 43 for providing work areas for operations by the CPU 41 and storing temporarily data sent from each part of the engine 1 as well as control signals to be sent out to each part of the engine 1, an input circuit 44 for receiving data sent from each part of the engine 1, and an output circuit 45 for sending control signals to each part of the engine 1.

Programs are represented by Module 1, Module 2, Module 3 and so on in FIG. 1. A program which controls an amount of evaporated fuel according to the invention is contained in one or more of these modules. Various data to be used for operations are stored in the form of Table 1, Table 2 and so on in ROM 42. ROM 42 may be a rewritable ROM such as EEPROM.

ECU 5 can store the result of its operations in the rewritable ROM in a certain operating cycle to utilize them in the next operating cycle. Also, many flags set by various processes can be recorded in the ROM. These flags can be utilized for a failure diagnosis purpose.

The internal-combustion engine (hereinafter referred to as engine) is, for example, an engine equipped with four cylinders. An intake manifold 2 is connected to the engine 1. A throttle valve 3 is disposed upstream of the intake manifold 2. A throttle valve opening (θ TH) sensor 4, which is connected to the throttle valve 3, outputs an electric signal corresponding to an opening angle of the throttle valve 3 and sends the electric signal to the ECU 5.

A fuel injection valve 6 is installed for each cylinder at an intermediate point in the intake manifold 2 between the engine 1 and the throttle valve 3. The opening time of each injection valve 6 is controlled by a control signal from the ECU 5. A fuel supply line 7 connects these fuel injection valves 6 and the fuel tank 9. A fuel pump 8 provided at an intermediate point in the fuel supply line 7 supplies fuel from the fuel tank 9 to the fuel injection valves 6. A regulator (not shown) that is provided between the pump 8 and the respective fuel injection valves 6 acts to maintain the differential pressure between the pressure of the air taken in from the intake manifold 2 and the pressure of the fuel supplied via the fuel supply line 7 at a constant value. In cases where the pressure of the fuel is too high, the excess fuel is returned to the fuel tank 9 via a return line (not shown). Thus, the air taken in via the throttle valve 3 passes through the intake manifold 2. The air is mixed with the fuel injected from the fuel injection valves 6, and is then supplied to the cylinders of the engine 1.

An intake manifold pressure (PBA) sensor 13 and an outside air temperature (TA) sensor 14 are mounted in the intake manifold 2 downstream of the throttle valve 3. These sensors convert the intake manifold pressure and outside air temperature into electrical signals, and send these signals to the ECU 5. An engine water temperature (TW) sensor 15 is attached to the cylinder peripheral wall, which is filled with cooling water, of the cylinder block of the engine 1. The sensor 15 detects the temperature of the engine cooling water. The detected engine water temperature is converted into an electrical signal, and the signal is sent to the ECU 5.

A cylinder discrimination sensor 34 is attached to the periphery of the camshaft or the periphery of the crankshaft of the engine 1, and outputs a cylinder discrimination signal CYL indicating which cylinder has reached a TDC position (top dead center). The output signal CYL is sent to the ECU 5.

Similarly, a TDC sensor 36 is attached to the periphery of the camshaft or the periphery of the crankshaft of the engine 1 and outputs a TDC signal pulse at a crank angle cycle (for example, for BTDC 10 degrees) associated with a TDC position of the piston. Furthermore, a crank angle sensor 38 is attached to output a CRK signal pulse at a predetermined crank angle cycle (for example, a cycle of 30 degrees) that is shorter than the TDC signal pulse cycle. These pulse signals are sent to the ECU 5.

The engine 1 has an exhaust manifold 12, and exhaust gases are discharged via a ternary catalyst 33 constituting an exhaust gas cleansing device, which is installed at an intermediate point in the exhaust manifold 12. A LAF sensor 32 mounted at an intermediate point in the exhaust manifold 12 is a full range air-fuel ratio sensor. The LAF sensor 32 detects the oxygen content in the exhaust gas in a wide air-fuel ratio zone, from a rich zone where the air-fuel ratio is richer than the theoretical air-fuel ratio to an extremely lean zone. The detected signal is sent to the ECU 5.

An ignition plug 58 is provided in the combustion chamber (not shown) of the engine 1. The ignition plug 58 is electrically connected to the ECU 5 through an ignition coil and an igniter 50. Additionally, a knock sensor 52 is attached to a cylinder head (not shown) of the engine 1 to output a signal in accordance with vibrations of the engine 1. The output signal is sent to the ECU 5.

A wheel speed (VPS) sensor 17 is provided in the periphery of a drive shaft (not shown) of the vehicle on which the engine 1 is mounted. The wheel speed sensor 17 outputs a pulse at every wheel rotation. The output pulse signal is sent to the ECU 5.

A battery voltage (VB) sensor 18 and an atmospheric pressure (PA) sensor 19 are connected to the ECU 5. The VB sensor 18 and PA sensor 19 detect a battery voltage and the atmospheric pressure, respectively. The detected signals are sent to the ECU 5.

Input signals from the various sensors are provided to an input circuit 44. The input circuit 44 shapes the input signal waveforms, corrects the voltage levels to specified levels, and converts analog signal values into digital signal values. The CPU 41 processes the resulting digital signals, performs operations in accordance with the programs stored in the ROM 42, and creates control signals. These control signals are sent to the output circuit 45. The output circuit 45 sends the control signals to actuators such as the fuel injection valves 6, igniter 50 and other actuators.

An evaporated fuel discharge prevention system 31 will be described. The discharge prevention system 31 is equipped with a fuel tank 9, a charging passage 20, a canister 25, a purging passage 27 and several control valves. This system controls the discharge of evaporated fuel from the fuel tank 9.

The fuel tank 9 is connected to the canister 25 via the charging passage 20, so that evaporated fuel from the fuel tank 9 can move into the canister 25. The charging passage 20 has a first branch 20*a* and a second branch 20*b*, which are provided inside the engine compartment. An internal pressure sensor 11 is attached to the fuel tank side of the charging passage 20. The sensor 11 detects the differential pressure between the pressure inside the charging passage 20 and the atmosphere. A two-way valve 23 which adjusts the pressure inside the fuel tank is provided in the first branch 20*a*. The two-way valve 23 has two mechanical valves 23*a* and 23*b*. The valve 23*a* is a positive-pressure valve which opens when the tank pressure exceeds atmospheric pressure by a predetermined amount. When this valve is in an open state, evaporated fuel flows into the canister 25, and is adsorbed there. The valve 23*b* is a negative-pressure valve which opens when the tank pressure drops below the pressure on the side of the canister 25 by a predetermined amount. When this valve is in an open state, the evaporated fuel adsorbed by the canister 25 returns to the fuel tank 9. A bypass valve 24 consisting of an electromagnetic valve is provided in the second branch 20*b*. This bypass valve 24 is ordinarily in a closed state.

The canister 25 is connected with the intake manifold 2 on the downstream side of the throttle valve 3 via the purging passage 27. A purge control valve 30 consisting of an electromagnetic valve is provided at an intermediate point in the purging passage 27, and the fuel adsorbed in the canister 25 is appropriately purged to the intake system of the engine via the purge control valve 30. The purge valve 30 continuously controls the flow rate by altering the on-off duty ratio on the basis of control signals from the ECU 5.

Figure 2:
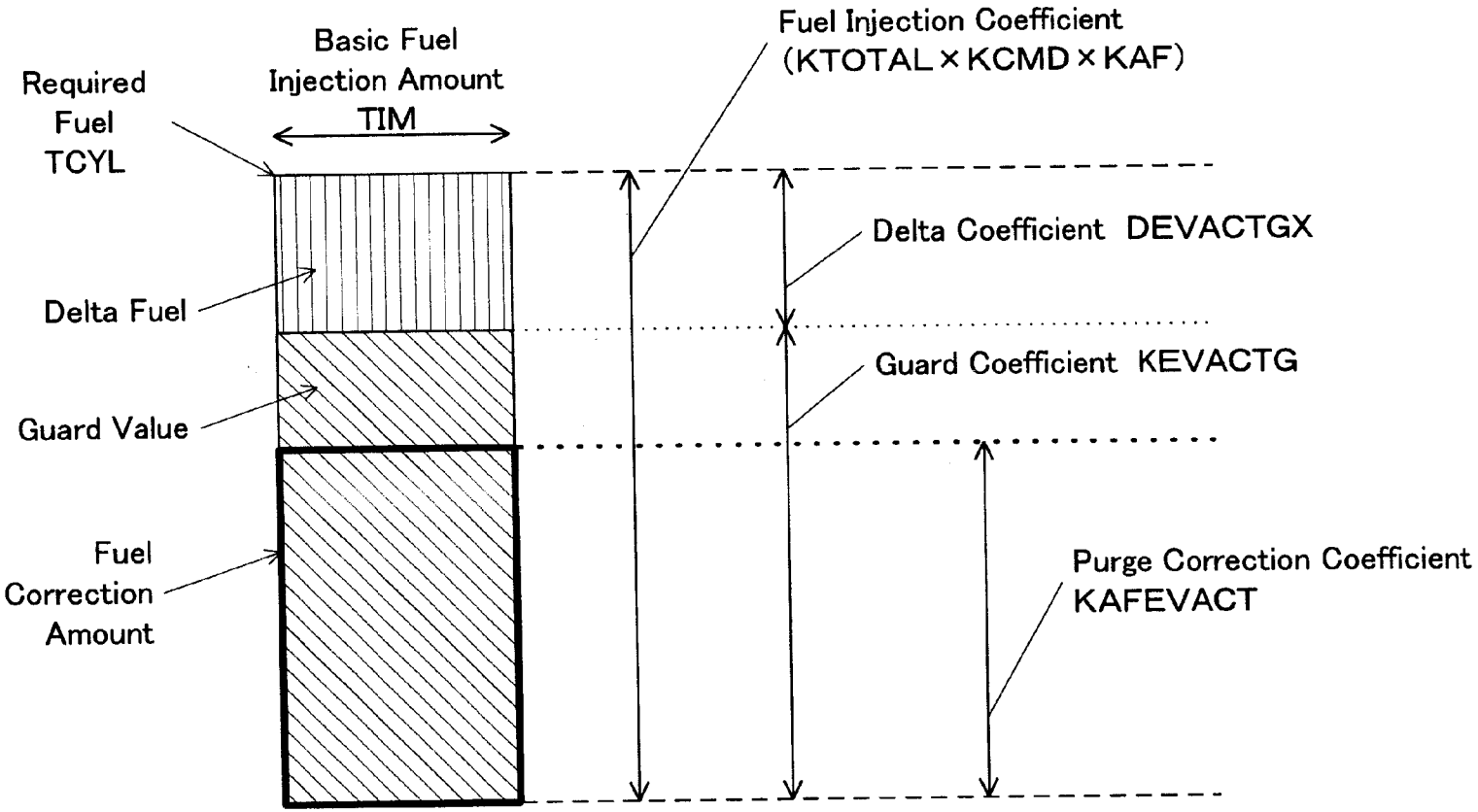
FIG. 2 is a graphical chart showing a relationship between a required fuel and an evaporated fuel that contributes to the required fuel according to one embodiment of the invention.

FIG. 2 shows a relationship between a required fuel and an evaporated fuel that contributes to the required fuel. The required fuel TCYL indicates an amount of the fuel to be supplied to each cylinder of the engine and is determined in accordance with driving conditions of the engine. The length of a horizontal side of a rectangle shown in FIG. 2 shows a magnitude of a basic fuel injection TIM and the length of a vertical side of the rectangle shows magnitudes of coefficients. The area of the rectangle having the horizontal side represented by the basic fuel injection TIM and the vertical side represented by a fuel injection coefficient indicates a magnitude of the required fuel TCYL. In other words, the required fuel TCYL is calculated by multiplying the basic fuel injection TIM by a fuel injection coefficient (KTOTAL×KCMD×KAF) as shown in the following equation (1):

$$TCYL = TIM \times (KTOTAL \times KCMD \times KAF) \quad (1)$$

In the equation (1), the basic fuel injection TIM is represented by a basic fuel injection time which is determined in accordance with the engine rotational speed NE and the intake manifold pressure PBA. KTOTAL is a correction coefficient which is determined based on signals detected by various sensors. This coefficient is set to optimize fuel consumption, acceleration and other characteristics of the engine in accordance with the driving conditions. KCMD is called a target air-fuel ratio coefficient, which represents a target air-fuel ratio in terms of the equivalent ratio. The target air-fuel ratio coefficient KCMD is proportional to the reciprocal of an air-fuel ratio A/F, i.e., proportional to a fuel/air ratio F/A, and takes a value of 1.0 for the stoichiometry. KAF indicates an air-fuel ratio correction coefficient. The air-fuel ratio correction coefficient KAF is determined based on an output signal from the LAF sensor 32 when the air-fuel feedback control is being performed so that an air-fuel ratio of air-fuel mixture supplied to the engine becomes equal to the target air-fuel ratio.

A section of the rectangle which is hatched with vertical lines in FIG. 2 shows a delta fuel that is determined by multiplying the basic fuel injection TIM by a delta coefficient DEVACTGX. The delta fuel indicates a minimum amount of fuel supplied to the engine through the fuel injection valves. The amount of the delta fuel is an amount required to properly control the air-fuel ratio under the air-fuel ratio feedback control for the current driving conditions. The delta fuel is calculated according to the following equation (2):

$$\text{Delta Fuel}=TIM\times DEVACTGX \quad (2)$$

The delta coefficient DEVACTGX in the equation (2) is represented by a ratio to the fuel injection coefficient and is determined in accordance with the driving conditions. In this embodiment, a map including relationships among the delta coefficient, the engine rotational speed and the intake manifold pressure is stored in advance (for example, it is stored in ROM 42 in FIG. 1). Thus, the delta coefficient DEVACTGX in accordance with the current driving conditions is obtained by retrieving the map based on the engine rotational speed NE and the air intake manifold pressure PBA.

A section which is hatched with oblique lines in FIG. 2 represents a guard value which is calculated by multiplying the basic fuel injection TIM by a guard coefficient KEVACTG. The guard value indicates an upper limit amount of the evaporated fuel able to be included in the required fuel. The guard value is obtained by the following equation (3):

$$\text{Guard Value}=TIM\times KEVACTG \quad (3)$$

The guard coefficient KEVACTG indicates an upper limit value of a ratio of the guard value to the required fuel amount TCYL. The guard coefficient KEVACTG is calculated by subtracting the delta coefficient DEVACTGX from the fuel injection coefficients (KTOTAL×KCMD×KAF) of the equation (1) as shown in the following equation (4):

$$KEVACTG=KTOTAL\times KCMD\times KAF-DEVACTGX \quad (4)$$

A sub-section surrounded by bold lines in the section of the guard value shows a fuel correction amount. The fuel correction amount is an evaporated fuel amount that contributes to the required fuel and is derived from a purge flow amount QPGC indicating a flow amount of the evaporated fuel purged to the intake system of the engine. The fuel correction amount is calculated by multiplying the basic fuel amount TIM by a purge correction coefficient KAFEVACT according to the following equation (5):

$$\text{Fuel Correction Amount}=TIM\times KAFEVACT \quad (5)$$

The purge correction coefficient KAFEVACT is represented by a ratio to the fuel injection coefficient and is determined based on the purge flow amount QPGC and an evaporated fuel density. Its calculation method will be described later.

According to the present invention, the fuel correction amount is controlled so that it does not exceed the guard value. More specifically, the delta coefficient DEVACTG is first calculated in accordance with the current driving conditions and then the guard coefficient KEVACTG is calculated, as described above. The purge correction coefficient KAFEVACT is controlled so that it does not exceed the guard coefficient KEVACTG.

In one embodiment of the invention, if the purge correction coefficient which is calculated in accordance with the below-described calculation method exceeds the guard correction coefficient KEVACTG, the purge correction coefficient KAFEVACT is set to the value of the guard correction coefficient KEVACTG. In contrast, if the calculated purge correction coefficient does not exceed the guard correction coefficient KEVACTG, the purge correction coefficient KAFEVACT is set to the value of the calculated purge correction coefficient. Thus, the fuel correction amount is controlled by the purge correction coefficient KAFEVACT so that it does not exceed the guard value. In other words, the amount of the evaporated fuel to be purged to the intake system is determined in a manner that the amount of the evaporated fuel that contributes to the required fuel does not exceed the guard value. The purge control valve is controlled so that the determined amount of the evaporated fuel is purged to the intake system. The fuel amount determined by subtracting the fuel correction amount from the required fuel is supplied to the engine through the fuel injection valve. Thus, the fuel amount equal to or greater than the delta fuel amount is surely supplied to the engine through the fuel injection valve.

Figure 3:
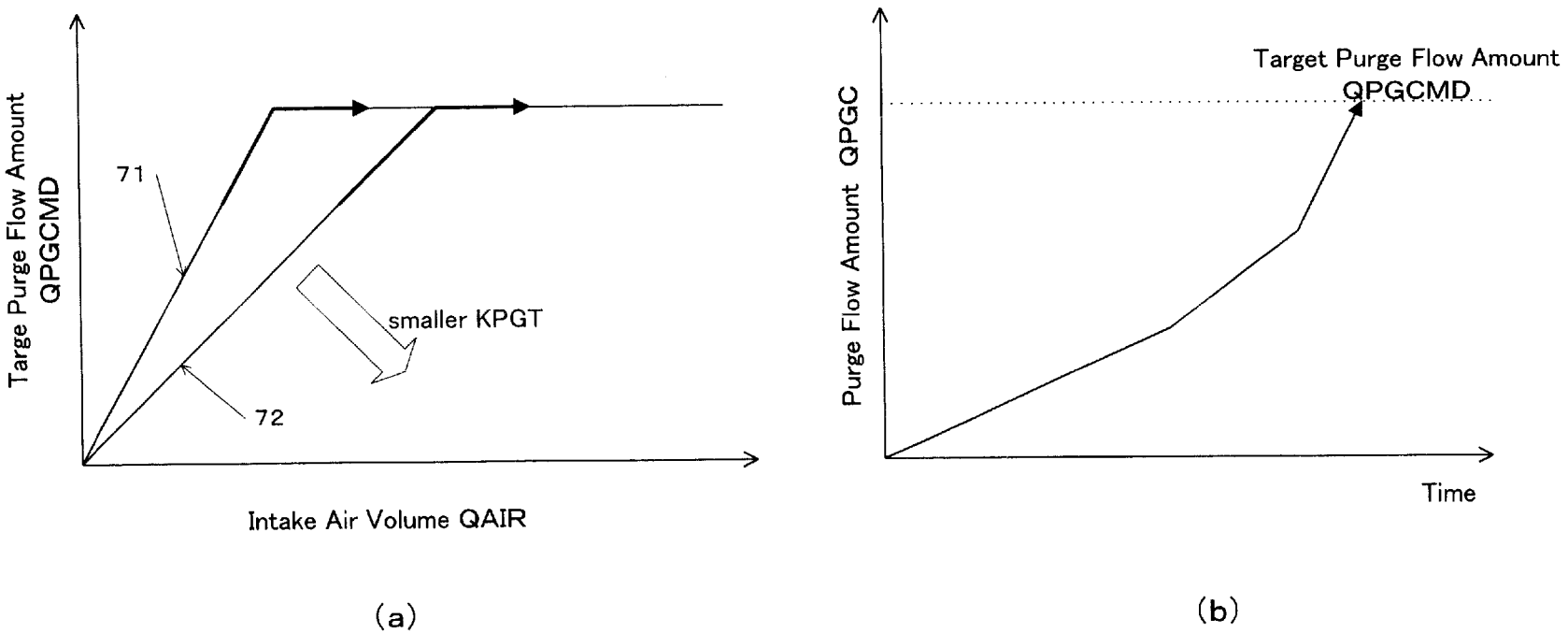
FIG. 3 is a graphical chart showing a target purge flow amount and a purge flow amount according to one embodiment of the invention.

Referring to FIG. 3, the above-mentioned purge flow amount QPGC will be described. At first, a target purge flow amount will be described with reference to FIG. 3(*a*). The target purge flow amount QPGCMD indicates a target value of the purge flow amount that is to be purged into the intake system of the engine in the current cycle. As shown in lines 71 and 72 in FIG. 3(*a*), the target purge flow amount QPGCMD is set in such a manner that its value increases in proportion to the increase of the intake air amount QAIR. This is because the increase of the purge flow amount has little influence on the air-fuel ratio when the intake air amount QAIR is larger. The target purge flow amount QPGCMD is maintained at a constant after the intake air amount QAIR has exceeded a predetermined value. This is due to a physical limitation of the purge flow amount.

The target purge flow amount QPGCMD is calculated based on the following equation (6):

$$QPGCMD=QPGCBASE\times KPGT \quad (6)$$

In the equation (6), QPGCBASE indicates a basic purge flow amount that is proportional to the intake air amount QAIR. KPGT is a purge flow amount coefficient. KPGT has a value of 1 or less. The target purge flow amount QPGCMD is adjusted through controlling this coefficient KPGT.

The coefficient KPGT in a case shown by the line 71 is larger than the coefficient KPGT in a case shown by the line 72. As seen from the lines 71 and 72, when the value of the coefficient KPGT is increased, the ratio of the target purge flow amount QPGCMD to the intake air amount QAIR is increased.

The coefficient KPGT is incremented by a predetermined amount in each cycle as long as the air-fuel ratio does not become rich and as long as the fuel correction amount that is derived from the purge flow amount does not exceed the guard value, as shown in FIG. 2. The increment operation is carried out so that as much amount of the evaporated fuel as possible is supplied into the engine as long as there is no influence upon the air-fuel ratio feedback control. However, when the air-fuel ratio approaches rich or when the fuel correction amount that is derived from the purge flow amount approaches the guard value, the increment operation of the coefficient KPGT is not performed. Thus, by means of controlling the value of the coefficient KPGT, the purge flow amount which flows into the engine is controlled so as to be maximized within a range in which the air-fuel ratio can be appropriately controlled.

In FIG. 3(*b*), a relationship between the target purge flow amount QPGCMD and the purge flow amount QPGC is shown. As shown in FIG. 3(*b*), the purge flow amount QPGC is controlled in such a manner that it gradually reaches the target purge flow amount QPGCMD. This is because there may be some influence on the air-fuel ratio if the target purge flow amount QPGCMD suddenly flows into the engine in the current cycle. Thus, in each cycle, the purge flow amount QPGC is calculated so that it never exceeds the target purge flow amount QPGCMD and then the purge control valve is controlled so that the calculated purge flow amount QPGC is purged to the intake system of the engine.

Figure 4:
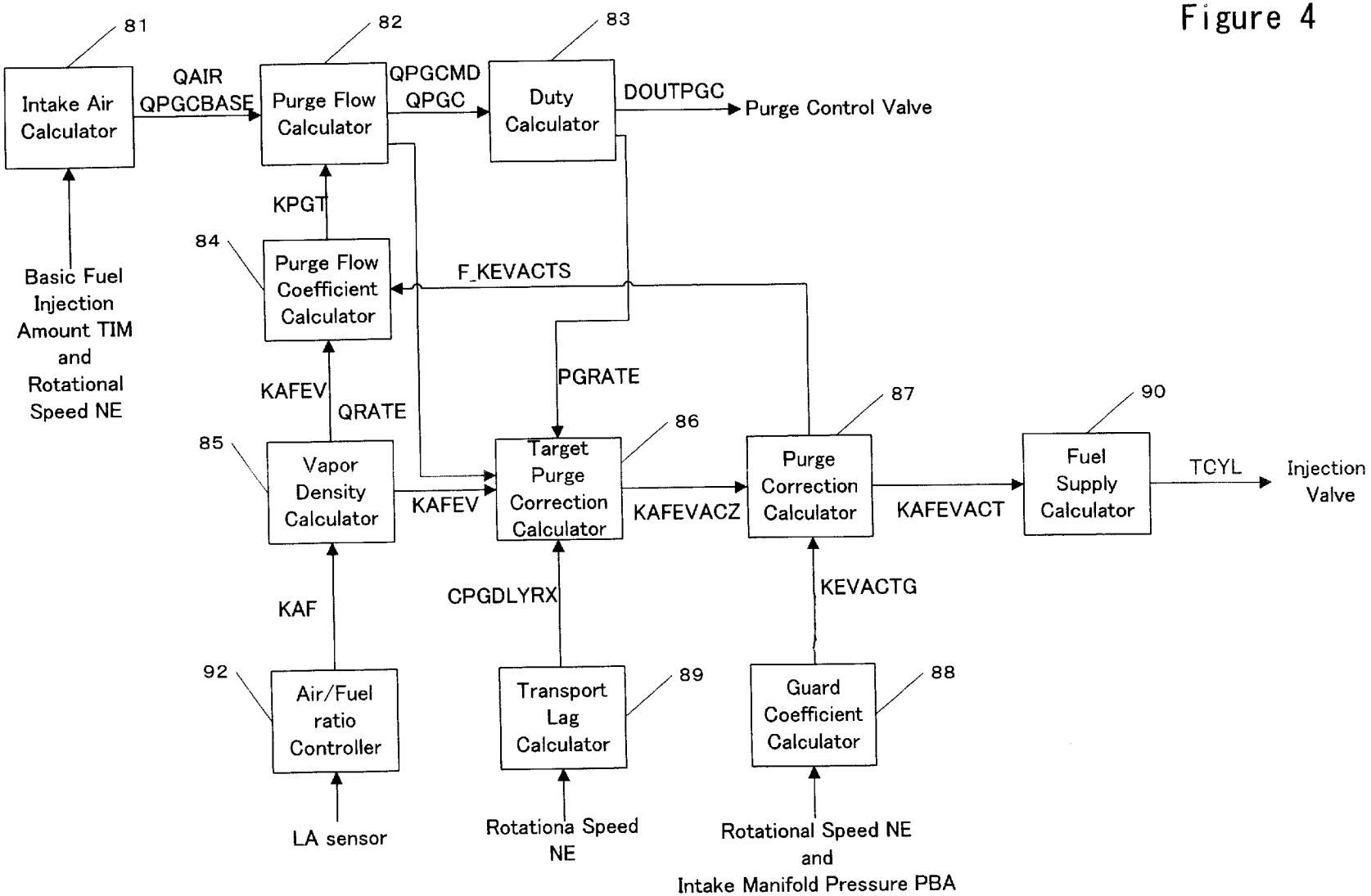
FIG. 4 is a functional block diagram of an evaporated fuel controller according to one embodiment of the invention.

FIG. 4 shows functional blocks of the evaporated fuel controller according to one embodiment of the present invention. A function represented by each functional block is typically implemented by a computer program. Alternatively, each functional block may be implemented by any hardware configured to perform a function represented by the functional block.

An intake air calculator 81 calculates the intake air amount QAIR indicating the amount of air taken from the intake manifold in accordance with the following equation (7):

$$QAIR=TIM\times NE\times 2\times KQAIR\times KPA \quad (7)$$

In the equation (7), TIM indicates the basic fuel injection amount as described above. KQAIR is a coefficient for converting the fuel injection amount to an airflow amount. The coefficient KQAIR has a fixed value (for example, 0.45L/ms). KPA is a coefficient for correcting a variation in the flow amount in accordance with the intake manifold pressure PBA.

The intake air calculator 81 further calculates a ratio of the evaporated fuel to the intake air amount QAIR in accordance with the following equation (8):

$$QPGCBASE=QAIR\times KQPGB \quad (8)$$

KQPGB in the equation (8) indicates a target purge ratio, which is, for example, 0.04. In this case, the evaporated fuel is included in 4% of the intake air amount QAIR. QPGCBASE is called a basic purge amount as described above.

A purge flow calculator 82 calculates a target purge flow amount QPGCMD based on the basic purge amount QPGCBASE in accordance with the above-mentioned equation (6).

The purge flow calculator 82 further calculates the purge flow amount to be purged in the current cycle based on the intake air amount QAIR according to the following equation (9):

$$QPGC(k)=QPGC(k-1)+(QAIR\times KDQPGC) \quad (9)$$

Here, k is a number for identifying a cycle; (k) for the current cycle and (k−1) for the previous cycle. KDQPGC is a predetermined fixed value (for example, 0.003). If the purge flow amount calculated by the equation (9) exceeds the target purge flow QPGCMD, the purge flow amount QPGC is set to the value of the target purge flow amount QPGCMD. Thus, the purge flow QPGC amount is controlled not to exceed the target purge flow amount QPGCMD.

A duty calculator 83 calculates a duty ratio PGCMD for driving the purge control valve in accordance with the following equation (10), so that the purge flow amount QPGC received from the purge flow calculator 82 is purged. The duty ratio indicates a ratio at which the purge control valve is opened.

$$PGCMD=PGCMD0+DPGCVBX+DPGC0 \text{ where } PGCMD0=QPGC\times KDUTY/KDPBG \quad (10)$$

KDUTY is a coefficient for converting the purge flow amount to the duty ratio. The coefficient KDUTY has a fixed value (for example, 3.8% min/L).

The opening degree of the purge control valve may change in accordance with the differential pressure. KDPBG is a coefficient for correcting the variation in the opening degree of the purge control valve. PGCMD0 indicates a duty ratio which corresponds to the purge flow amount QPGC. PGCMD0 will be hereinafter referred to as a target duty ratio.

There may occur some delay depending on a battery voltage VB and the intake manifold pressure PBA before the purge control valve starts to open. The coefficients DPGCVBX and DPGC0 correct the delay in accordance with the battery voltage VB and the intake manifold pressure PBA, respectively. This delay will be hereinafter referred to as a dead time.

A duty calculator 83 performs a limit process upon the duty ratio PGCMD with a predetermined upper limit value and a predetermined lower limit value, so as to output a final duty ratio DOUTPGC. Thus, the opening degree of the purge control valve is controlled in accordance with the final duty ratio DOUTPGC.

A purge flow coefficient calculator 84 calculates the purge flow amount coefficient KPGT. The purge flow coefficient calculator 84 increments the coefficient KGBT by a predetermined amount in each cycle as long as it does not receive a flag F_KEVACTS having a value of 1 from a purge correction calculator 87. An update time for performing the incremental process is determined based on a density of the evaporated fuel density (which is hereinafter referred to as a vapor density coefficient KAFEV) and the intake air amount QAIR. As the vapor density coefficient KAFEV becomes larger or the intake air amount QAIR becomes smaller, the update time is set to be longer so that the target purge flow amount QPGCMD is increased more gradually.

The purge flow coefficient calculator 84 keeps the coefficient KPGT unchanged when it receives the F_KEVACTS having a value of 1 from the purge correction calculator 87. The coefficient KPGT is passed to the purge flow calculator 82 and is used for calculating the target purge flow amount QPGCMD as described above.

An air-fuel ratio controller 92 carries out the air-fuel ratio feedback control based on the output of the LAF sensor 32. A vapor density calculator 85 calculates the vapor density coefficient KAFEV based on a feedback coefficient KAF that is calculated by the air-fuel ratio controller 92.

A target purge correction calculator 86 and the purge correction calculator 87 calculate a target purge correction coefficient KAFEVACZ and the purge correction coefficient KAFEVACT, respectively. The coefficients have a relationship shown in the following equation (11):

$$KAFEVACT=KAFEVACZ\times KKEVG \quad (11)$$

KKEVG indicates a high density correction coefficient. When the evaporated fuel density is very high, the air-fuel ratio is significantly influenced. The coefficient KKEVG corrects the influence. The high density correction coefficient KKEVG is set to a value of 1 or more in accordance with the evaporated fuel density. As described with reference to FIG. 2, the purge correction coefficient KAFEVACT indicates a ratio of the fuel correction amount that contributes to the required fuel. The ratio is first calculated as a target purge correction coefficient KAFEVACZ. Then, the target purge correction coefficient KAFEVACZ is multiplied by the high density correction coefficient KKEVG to determine the purge correction coefficient KAFEVACT.

The target purge correction calculator 86 calculates the target purge correction coefficient KAFEVACZ according to the following equation (12):

$$KAFEVACZ=KAFEV\times PGRATE\times QRATE \quad (12)$$

PGRATE and QRATE are calculated in accordance with the following equations (13) and (14), respectively:

$$PGRATE=(DOUTPGC-DPGCVBX-DPGC0)/PGCMD0 \quad (13)$$

$$QRATE=QPGC/QPGCBASE \quad (14)$$

"PGRATE×QRATE" indicates a ratio of a purge flow amount to be purged into the intake system of the engine in the current cycle to the maximum purge flow amount which can be purged to the intake system of the engine. More specifically, since DOUTPGC indicates the final duty ratio as described above, the duty rate PGRATE shown in the equation (13) indicates a ratio of an actual duty ratio (in which the dead time is subtracted) to the target duty ratio PGCMD0 corresponding to the purge flow amount QPGC. Accordingly, PGRATE×QPGC indicates an actual purge flow amount which is purged by the purge control valve in the current cycle. On the other hand, as described with reference to the equation (8), QPGCBASE indicates the flow amount of the evaporated fuel which can be included in the intake air amount QAIR in the current cycle. Because the intake air amount QAIR corresponds to the required fuel TCYL, a ratio of the target purge correction coefficient KAFEVACZ to the fuel injection coefficient (KTOTAL×KCMD×KAF) is proportional to a ratio of PGRATE×QPGC to the basic purge flow amount QPGCBASE. Because a fuel amount is dependent on the vapor density coefficient KAFEV, the target purge correction coefficient KAFEVACZ is obtained by multiplying "PGRATE×QRATE" by the vapor density coefficient KAFEV as shown in the equation (12).

The purge correction calculator 87 calculates the purge correction coefficient KAFEVACT by multiplying the target purge correction coefficient KAFEVACZ by the high density correction coefficient KKEVG as described above.

A guard coefficient calculator 88 determines a guard coefficient KEVACTG based on the engine rotational speed NE and the intake manifold pressure PBA. More specifically, as described with reference to FIG. 2, the guard coefficient calculator 88 retrieves a map based on the engine rotational speed NE and the intake manifold pressure PBA to determine the delta coefficient DEVACTGX. The guard coefficient calculator 88 determines the guard coefficient KEVACTG based on the determined delta coefficient DEVACTGX, as shown in the equation (4). The guard coefficient calculator 88 provides the calculated guard coefficient KEVACTG to the purge correction calculator 87.

The purge correction calculator 87 compares the calculated purge correction coefficient KAFEVACT with the guard coefficient KEVACTG. When the value of the purge correction coefficient is close to the value of the guard coefficient KEVACTG, the purge correction coefficient calculator 87 sets the flag F_KEVACTS to 1. When the value of the purge correction coefficient exceeds the value of the guard coefficient KEVACTG, the purge correction coefficient calculator 87 sets the purge correction coefficient KAFEVACT to the value of the guard coefficient KEVACTG and sets the flag F_KEVACTS to 1. Thus, the purge correction coefficient KAFEVACT is controlled not to exceed the value of the guard coefficient KEVACTG. In other words, as shown in FIG. 2, the fuel correction amount is controlled not to exceed the upper limit value (i.e., the guard value).

As described above, when the purge flow coefficient calculator 84 receives the flag F_KEVACTS having a value of 1 from the purge correction coefficient calculator 87, it keeps the coefficient KPGT unchanged so as to prevent the target purge flow amount QPGCMD from increasing. Thus, the purge amount that flows into the engine is controlled in accordance with the purge correction coefficient.

A transport lag calculator 89 calculates a purge transport lag CPGDLYRX based on the engine rotational speed NE. The purge transport lag CPGDLYRX indicates a time delay between the time when evaporated fuel is purged into the purge passage and the time when it reaches the intake system of the engine. The purge transport lag CPGDLYRX is represented by an integer n. As the value of n becomes larger, it indicates that the transport lag becomes greater. Alternatively, the purge transport lag may be calculated based on the intake air amount QAIR instead of the engine rotational speed NE.

The target purge correction calculator 86 comprises a plurality of buffers which are assigned respective numbers of 0 to (n−1) for storing target purge correction coefficients in time sequence. The target purge correction coefficient calculated in the current cycle (k) is stored in the 0th buffer, the target purge correction coefficient calculated in the previous cycle (k−1) is stored in the 1st buffer, and so on. The target purge correction coefficient calculator 86 receives a value n for the evaporated fuel transport lag CPGDLYRX calculated by the transport lag calculator 89 and extracts the target purge correction coefficient KAFEVACZ from the buffer corresponding to the number n. For example, if the value n of the received CPGDLYRX is 3, the target purge correction coefficient KAFEVACZ is extracted from the third buffer.

A fuel supply calculator 90 receives the purge correction coefficient KAFEVACT from the purge correction calculator 87 to correct the required fuel amount TCYL in accordance with the equation (15).

$$TCYL=TIM\times(KTOTAL\times KCMD\times KAF-KAFEVACT) \quad (15)$$

The corrected required fuel TCYL is supplied to the engine through the fuel injection valve. Thus, a fuel amount obtained by subtracting the fuel correction amount from the required amount TCYL shown in the above-mentioned equation (1) is supplied to the engine through the fuel injection valve. In other words, a fuel amount obtained by subtracting the evaporated fuel amount corresponding to the purge flow amount QPGC from the required fuel amount TCYL is supplied to the engine through the fuel injection valves.

Figure 5:
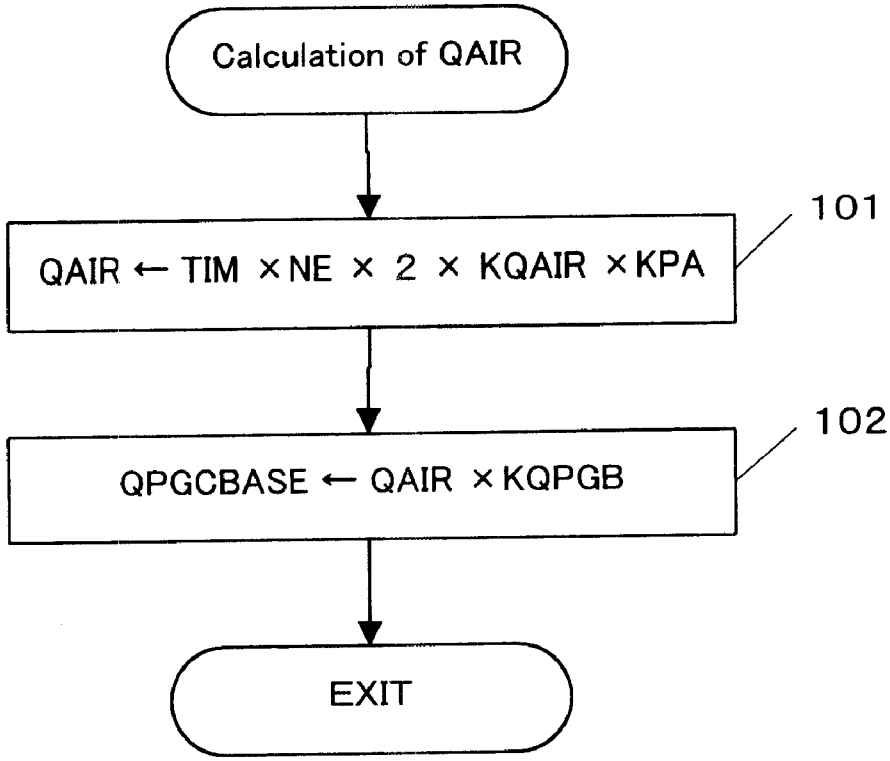
FIG. 5 is a flowchart for determining an intake air amount QAIR according to one embodiment of the invention.

FIG. 5 is a flowchart of a process for determining the intake air amount QAIR and the basic purge flow amount QPGBASE. The process is performed, for example, every time the TDC pulse signal is output from the TDC sensor. In step 101, the intake air amount QAIR is determined in accordance with the above-mentioned equation (7). In step 102, the basic purge flow amount QPGCBASE is determined in accordance with the above-mentioned equation (8).

Figure 6:
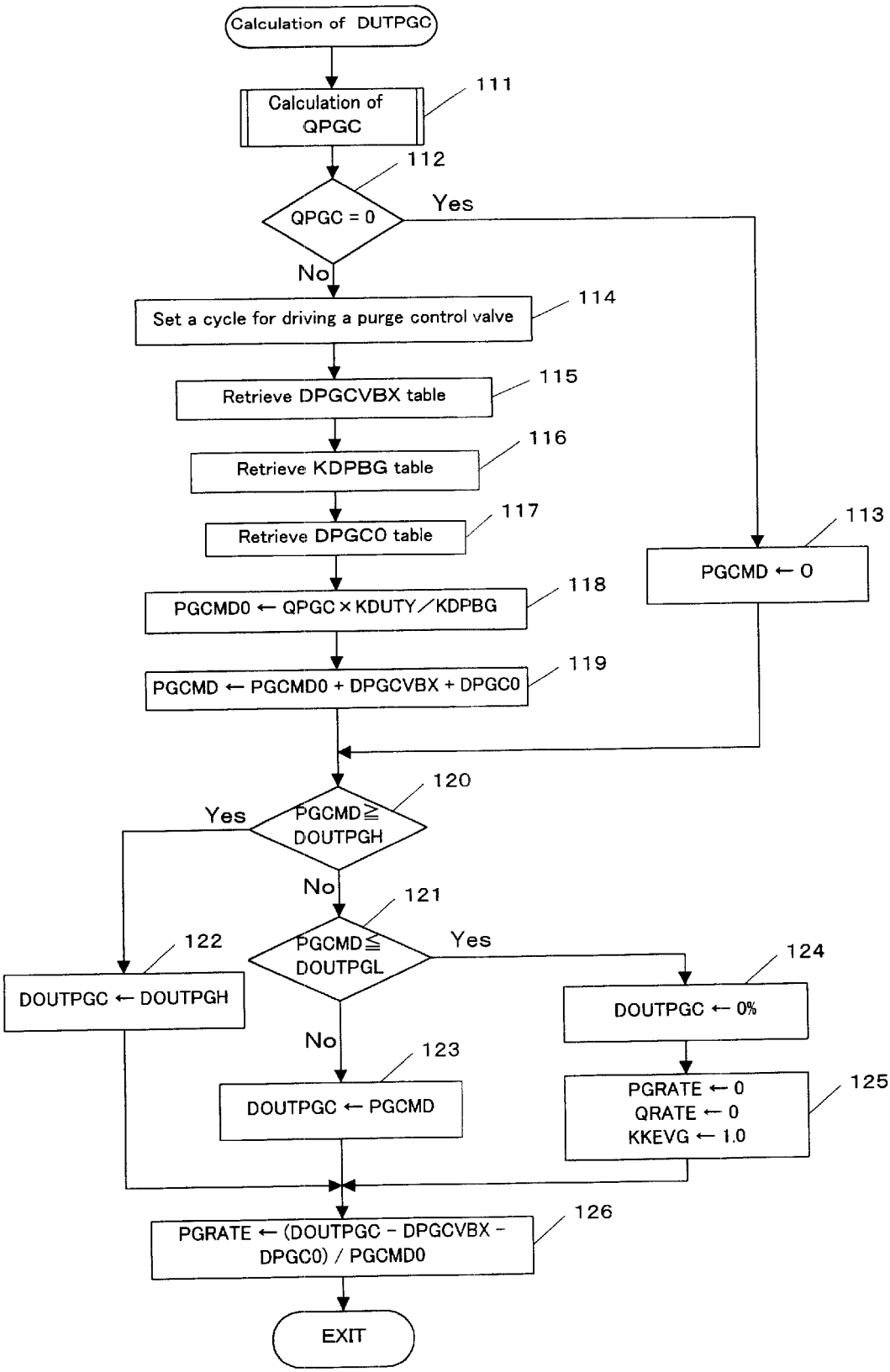
FIG. 6 is a flowchart for determining a duty PGCMD for driving a purge control valve according to one embodiment of the invention.

FIG. 6 is a flowchart of a process for determining the final duty ratio DOUTPGC for driving the purge control valve. The process is carried out repeatedly at predetermined time intervals (for example, eighty milliseconds).

In step 111, a routine for determining the purge flow amount QPGC 20 (FIG. 7) is carried out. If the purge flow amount QPGC determined in step 111 is zero, it indicates that the evaporated fuel will not be purged (112). In this case, the duty ratio PGCMD is set to zero in step 113 and the process proceeds to step 120. If the purge flow amount QPGC is not zero in step 112, the process proceeds to step 114, in which a cycle for driving the purge control valve (for example, eighty milliseconds) is set.

Figure 13:
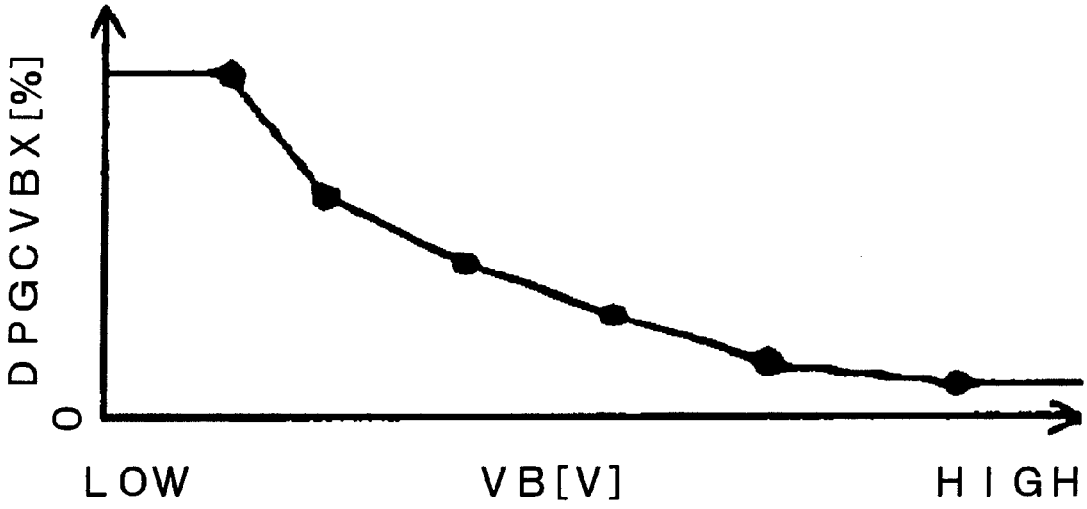
FIG. 13 is an example of a DPGCVBX table for obtaining a dead time based on the battery voltage according to one embodiment of the invention.

In steps 115 through 119, the duty ratio PGCMD is determined in accordance with the above-mentioned equation (10). In step 115, in order to correct the dead time of the purge control valve in accordance with the battery voltage, a DPGCVBX table is retrieved based on the battery voltage VB to determine the dead time DPGCVBX. FIG. 13 shows an example of the DPGCVBX table. As seen in FIG. 13, the dead time DPGCVBX decreases in accordance with the increase of the battery voltage VB.

Figure 14:
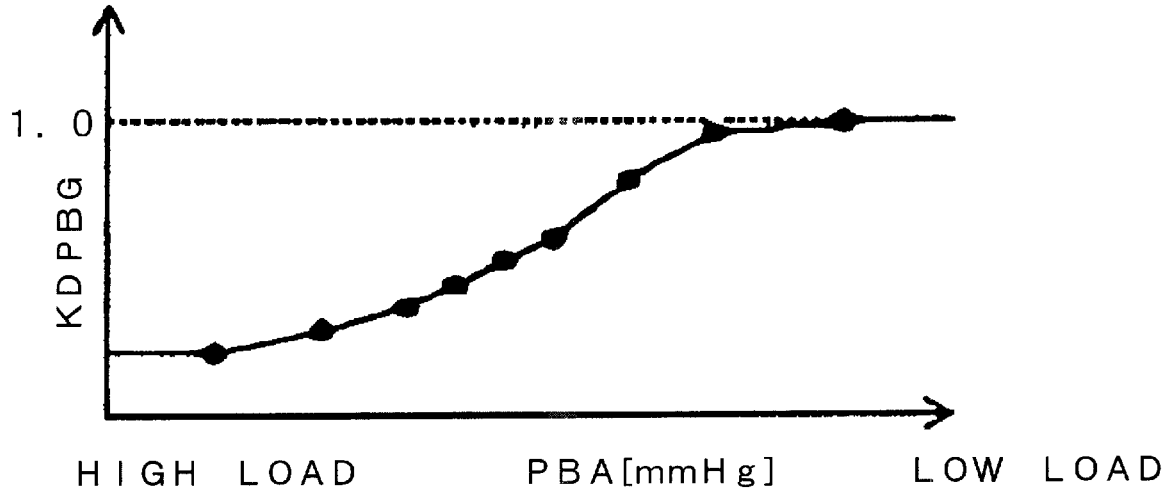
FIG. 14 is an example of a KDPBG table for obtaining a coefficient for correcting a duty based on a variation caused by a differential pressure according to one embodiment of the invention.
Figure 15:
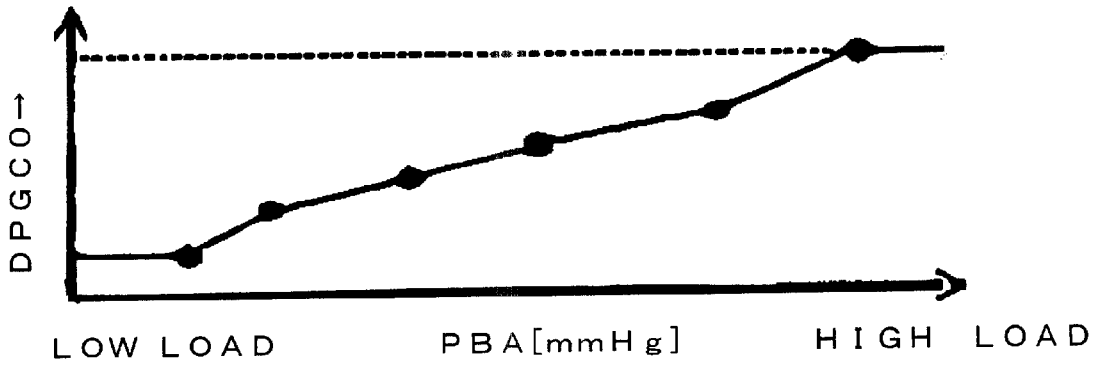
FIG. 15 is an example of a DPGC0 table for obtaining a dead time based on an intake manifold pressure according to one embodiment of the invention.

In step 116, in order to correct a variation in the duty of the purge control valve which is caused by the differential pressure, a KDPBG table is retrieved based on the intake manifold pressure PBA to determine the differential pressure correction value KDPBG. FIG. 14 shows an example of the KDPBG table. As seen in FIG. 14, the differential pressure correction value KDPBG increases in accordance with the decrease of the engine load. In step 117, in order to correct the dead time of the purge control valve in accordance with the intake manifold pressure PBA, a DPGC0 table is retrieved based on the intake manifold pressure PBA to determine the dead time DPGC0. FIG. 15 shows an example of the DPGC0 table. As seen in FIG. 15, the dead time DPGC0 increases in accordance with the increase of the load.

The process proceeds to step 118, in which the target duty ratio PGCMD0 corresponding to the purge flow amount QPGC is determined. More specifically, the purge flow amount QPGC calculated in step 111 is multiplied by the coefficient KDUTY for converting a flow amount to a duty value. The obtained value is divided by the differential pressure correction value KDPBG determined in step 116 to determine the target duty ratio PGCMD0.

In step 119, the duty ratio PGCMD is determined based on the target duty ratio PGCMD0. More specifically, the dead time DPGCVBX, which is determined in step 115 based on the battery voltage, and the dead time DPGC0, which is determined in step 117 based on the load, are added to the target duty ratio PGCMD0 to determine the duty ratio PGCMD.

In steps 120 through 125, a limit process for the duty ratio PGCMD is carried out. If the duty ratio PGCMD is equal to or greater than a predetermined upper limit value DOUTPGH (for example, 95%) in step 120, the final duty ratio DOUTPGC is set to the upper limit value DOUTPGH in step 122. If the duty ratio PGCMD has a value between the upper limit value DOUTPGH and a predetermined lower limit value DOUTPGL (for example, 5%) in steps 120 and 121, the final duty ratio DOUTPGC is set to the value of the duty ratio PGCMD in step 123.

If the duty ratio PGCMD is equal to or less than the lower limit value DOUTPGL in step 121, the final duty ratio DOUTPGC is set to zero in step 124. Because the final duty ratio DOUTPGC is zero, the duty rate PGRATE and the purge flow amount rate QRATE are set to zero and the high density correction coefficient KKEVG is set to 1 in step 125.

The process proceeds to step 126, in which the duty rate PGRATE is determined in accordance with the above-mentioned equation (13).

Figure 7:
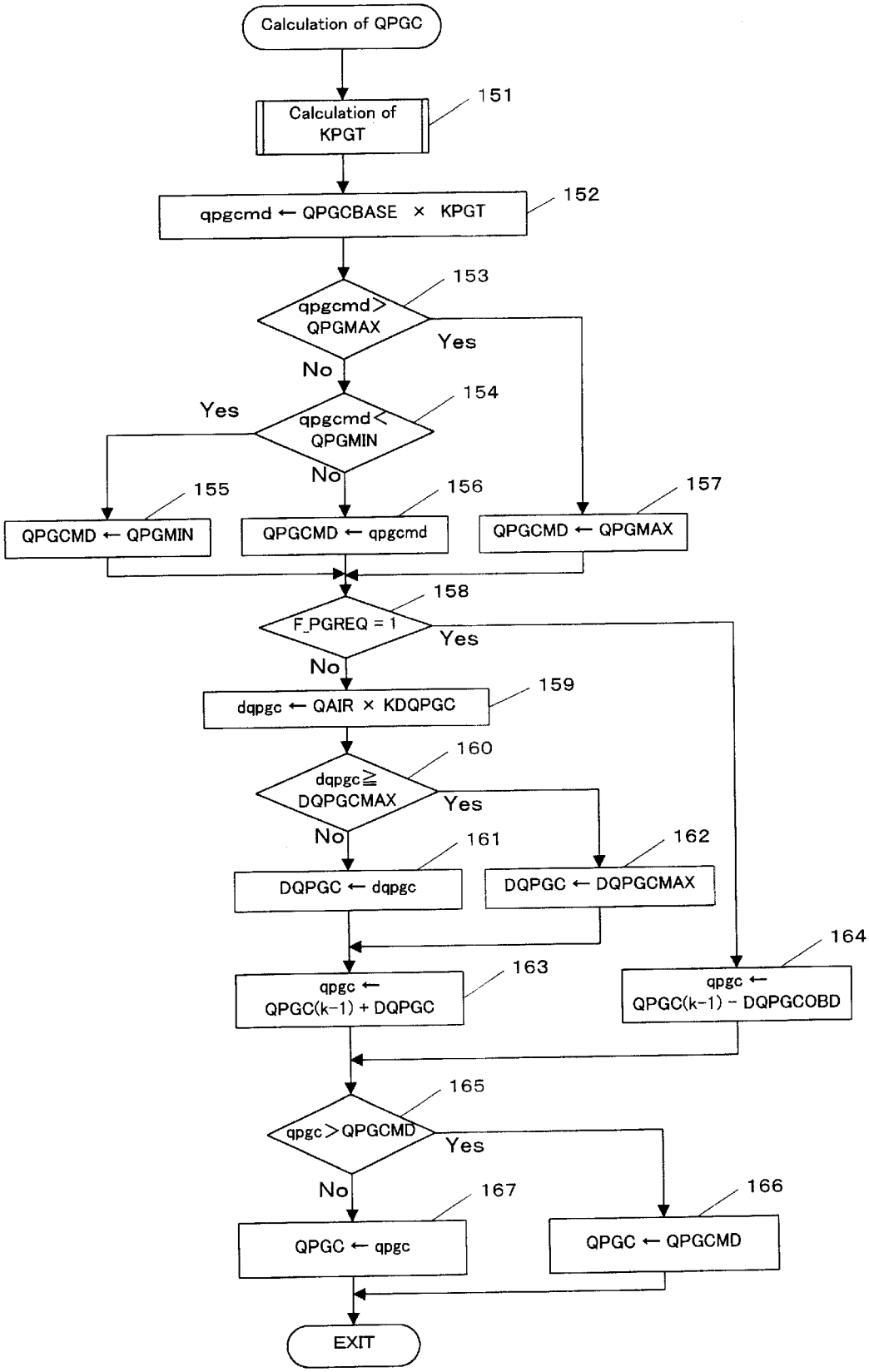
FIG. 7 is a flowchart for determining a purge flow amount QPGC according to one embodiment of the invention.

FIG. 7 is a flowchart of a process for determining the purge flow amount QPGC, which is performed in step 111 of FIG. 6. In step 151, a routine for determining the purge flow amount coefficient KPGT is carried out. In steps 152 through 157, the target purge flow amount QPGCMD is determined. In step 152, a value obtained by multiplying the basic purge flow amount QPGCBASE by the coefficient KPGT is set in a temporary variable "qpgcmd".

If the temporary variable qpgcmd exceeds a predetermined upper limit value QPGMAX (for example, 30 L/min) in step 153, the purge flow amount QPGCMD is set to the upper limit value in step 157. If the temporary variable qpgcmd is less than a predetermined lower limit value QPGMIN (for example, 1 L/min) in step 154, the purge flow amount QPGCMD is set to the lower limit value in step 155. If the temporary variable qpgcmd is between the upper limit value and the lower limit value, the target purge flow amount QPGCMD is set to the value of the temporary variable qpgcmd in step 156.

In steps 158 through 167, the purge flow amount QPGC is determined in accordance with the above-mentioned equation (9). As described above, the purge flow amount QPGC is controlled to gradually reach the target purge flow amount QPGCMD.

At first, a delta purge amount DQPGC to be added in the current cycle is calculated in steps 158 through 162. In step 158, it is checked whether a purge cut flag F_PGREQ is 1. If the purge cut flag is 1, it indicates that the purge cut is being performed. In other words, it indicates that the purge process is not being performed. In this case, a predetermined value DQPGCOBD (for example, 2 L/min) is deducted from the purge flow amount QPGC(k−1) which has been calculated in the previous cycle. The obtained value is set in the temporary variable qpgc in step 164.

If the purge cut flag F_PGREQ is zero in step 158, "the intake air amount QAIR×the purge addition coefficient KDQPGC" is set in the temporary variable dqpgc. The purge addition coefficient KDQPGC (for example, 0.003) is a coefficient for defining how much amount of the purge flow to be added to the intake air amount QAIR.

If the value of the temporary variable dqpgc is equal to or greater than a predetermined upper limit value DQPGCMAX (for example, 2 L/min) in step 160, the delta purge amount DQPGC is set to the upper limit value in step 162. If the value of the temporary variable dqpgc is less than the predetermined upper limit value DQPGCMAX in step 160, the delta purge amount DQPGC is set to the value of the temporary variable dqpgc in step 161.

In step 163, the delta purge amount DQPGC obtained in step 161 or step 162 is added to the purge flow amount QPGC(k−1) calculated in the previous cycle. Thus, the purge flow amount is incremented to approach the target purging flow amount QPGCMD.

In step 165, it is determined whether the incremented temporary variable qpgc exceeds the target purge flow amount QPGCMD. If the temporary variable qpgc exceeds the target purge flow amount QPGCMD, the purge flow amount QPGC is set to the value of the target purge flow amount QPGCMD in step 166. If the temporary variable qpgc does not exceed the target purge flow amount QPGCMD, the purge flow amount QPGC is set to the value of the temporary variable qpgc in step 167. Thus, the purge flow amount QPGC to be purged in the current cycle is determined in such a manner that it does not exceed the target purge flow amount QPGCMD.

Figure 8:
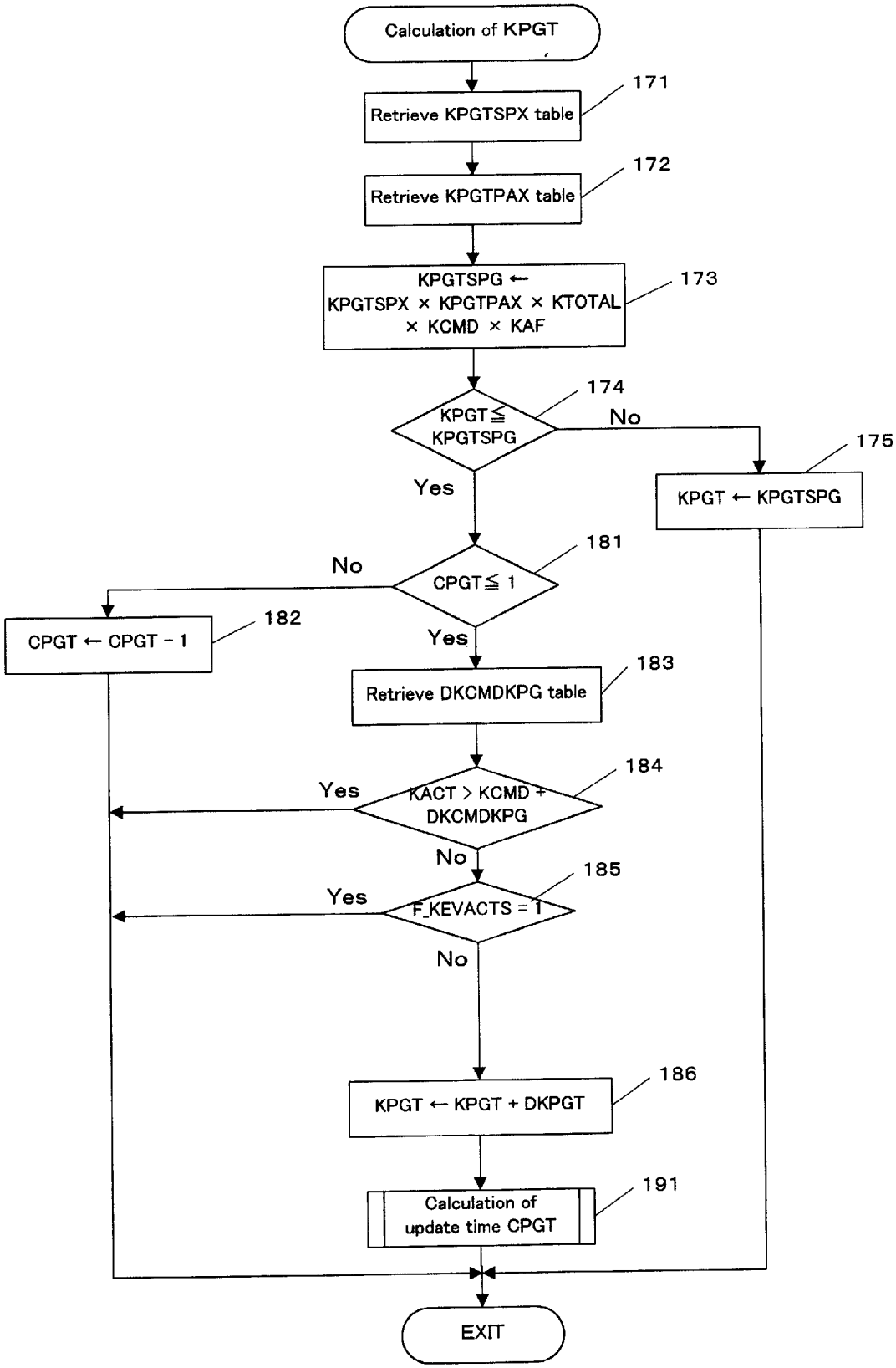
FIG. 8 is a flowchart for determining a purge flow amount coefficient KGPT according to one embodiment of the invention.

FIG. 8 is a flowchart of a process for determining the purge flow amount coefficient KPGT, which is performed in step 151 of FIG. 7. It is assumed that an initial value of the coefficient KPGT is zero. In steps 171 through 173, an upper limit value of the coefficient KPGT is determined. Setting the upper limit value of the coefficient KPGT in accordance with the driving conditions enables the accuracy of the purge flow amount control using the coefficient KPGT to be improved.

In step 171, a KPGTSPX map is retrieved based on the vapor density coefficient KAFEV and the intake air amount QAIR to determine a coefficient KPGTSPX. The KPGTSPX map is a map for storing a coefficient KPGTSPX based on the vapor density coefficient KAFEV and the intake air amount QAIR.

Figure 16:
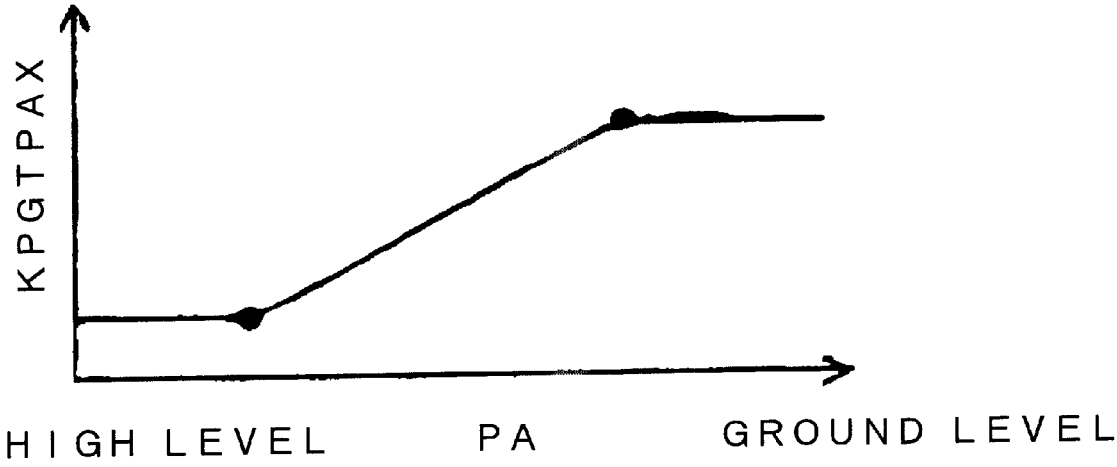
FIG. 16 is an example of a KPGTPAX table for obtaining a coefficient KPGTPAX for correcting an upper limit value of a purge flow correction coefficient KPGT based on variation caused by the atmospheric pressure according to one embodiment of the invention.

In step 172, a KPGTPAX table is retrieved based on the atmospheric pressure PA to determine a coefficient KPGTPAX. FIG. 16 shows an example of the KPGTPAX table. As seen in FIG. 16, the coefficient KPGTPAX increases in accordance with the increase of the atmospheric pressure PA. The coefficient KPGTPAX has a maximum value at the ground. In step 173, an upper limit value KPGTSPG is calculated in accordance with the following equation (16):

$$\text{Upper Limit Value } KPGTSPG = KPGTSPX \times KPGTPAX \times KTOTAL \times KCMD \times KAF \quad (16)$$

If the current KPGT is greater than the upper limit value KPGTSPG in step 174, the coefficient KPGT is updated with the upper limit value in step 175. If the current KPGT is equal to or less than the upper limit value KPGTSPG in step 174, the process proceeds to step 181.

In steps 181 through 185, it is determined whether predetermined conditions necessary to add the coefficient KPGT are satisfied. As described with reference to FIG. 3, the coefficients KPGT is incremented when the air-fuel ratio is lean and the fuel correction amount corresponding to the purge flow amount is not close to the guard value.

In step 181, it is determined whether the update time CPGT is equal to or less than 1. As described with reference to FIG. 4, the update time CPGT defines a time period for updating the coefficient KPGT. In this embodiment, the update time CPGT works like a counter. If the update time CPGT is greater than 1, it indicates that the update time CPGT has not yet expired. The CPGT is decremented by one (182) and then the process exits the routine.

Figure 17:
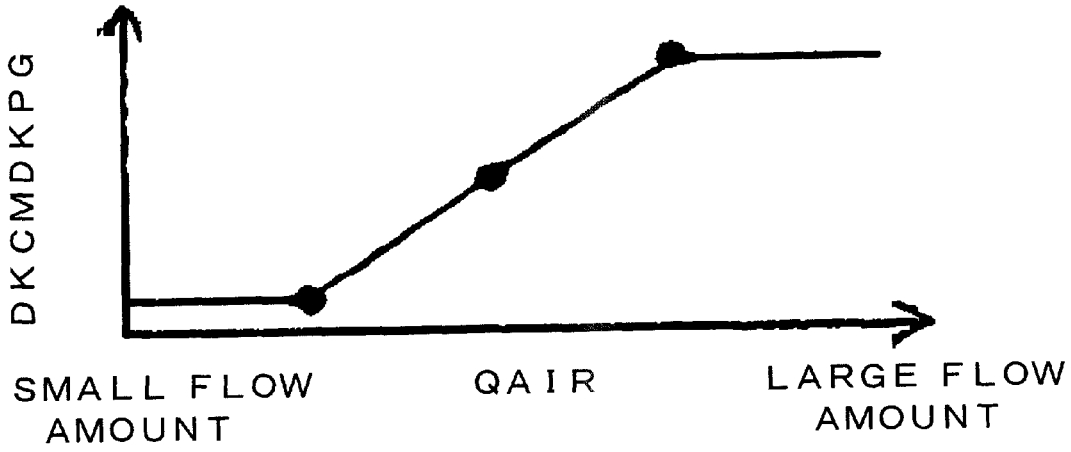
FIG. 17 is an example of a DKCMDKPG table for obtaining a deviation of a target air-fuel ratio KCMD according to one embodiment of the invention.

If the update time CPGT is equal to or less than 1, it indicates that the update time CPGT has expired. The process proceeds to step 183, in which a DKCMDKPG table is retrieved based on the intake air amount QAIR to determine a delta value DKCMDKPG. FIG. 17 shows an example of the DKCMDKPG table. As seen from FIG. 17, the delta value DKCMDKPG is set so that it increases in proportion to the increase of the intake air amount QAIR.

In step 184, if an actual air-fuel ratio coefficient KACT is greater than the sum of the target air-fuel ratio coefficient KCMD and the delta value DKCMDKPG obtained in step 183, the process exits the routine. Otherwise, the process proceeds to step 185. The actual air-fuel ratio coefficient KACT represents the air-fuel ratio detected by the LAF sensor in terms of the equivalent ratio. Thus, when the air-fuel ratio is close to rich, the process exits the routine without increasing the coefficient KPGT, thereby preventing the air-fuel ratio from getting over-rich.

In step 185, the process examines a flag F_KEVACTS which is set to 1 when the purge correction coefficient KAFEVACT has a value close to the guard coefficient KEVACTG. If the flag F_KEVACTS is 1, it indicates that the value of the purge correction coefficient KAFEVACT is close to the guard coefficient KEVACTG. In this case, the process exits the routine so that the purge flow amount is not increased. If the flag F_KEVACTS is not 1, the process proceeds to step 186, in which the coefficients KPGT is incremented by a predetermined value DKPGT (for example, 0.05).

Thus, the addition operation of the coefficient KPGT is performed only when the air-fuel ratio will not become rich and the fuel correction amount does not exceed the upper limit value even if the addition is performed. Then, in step 191, a routine (FIG. 9) for determining the update time CPGT is performed.

Figure 9:
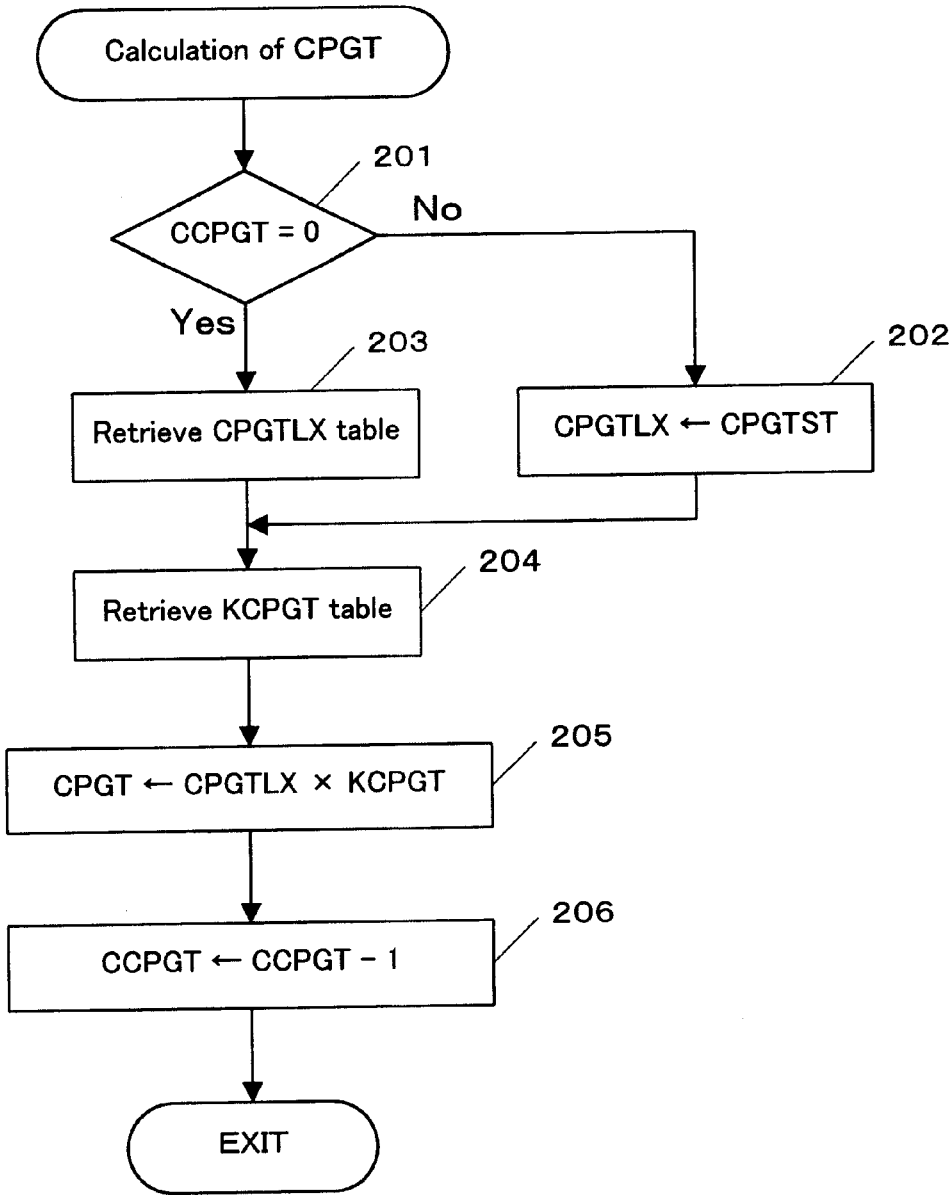
FIG. 9 is a flowchart for determining an update time CPGT according to one embodiment of the invention.

FIG. 9 is a flowchart of a process for determining the update time CPGT. As described above, the update time CPGT defines a time period for updating the coefficient KPGT. In step 201, a value of a counter CCPGT is examined. The value of the counter CCPGT is initially set to, for example, 5. If the value of the counter CCPGT is not zero, it indicates that the counter has not yet expired. The process proceeds to step 202, in which an update basic time CPGTLX is set to a predetermined value CPGTST (for example, 1.2 seconds).

Figure 18:
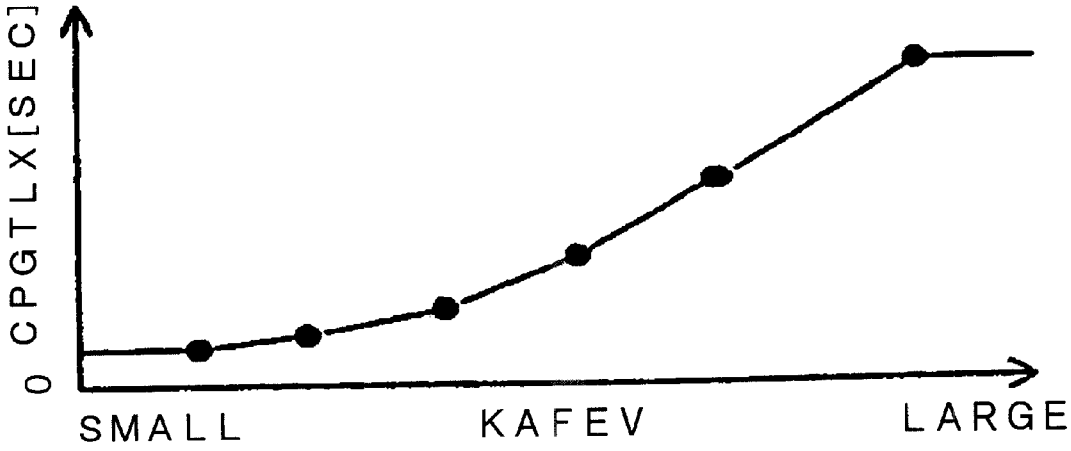
FIG. 18 is an example of a CPGTLX table for obtaining a basic update time CPGTLX of a purge flow correction coefficient KGPT based on a vapor density coefficient KAFEV according to one embodiment of the invention.

If the value of the counter CCPGT is zero, a CPGTLX table is retrieved based on the vapor density coefficient KAFEV to determine the update basic time CPGTLX in step 203. FIG. 18 shows an example of the CPGTLX table. As seen in FIG. 18, the update basic time CPGTLX increases in accordance with the increase of the vapor density coefficient KAFEV. Thus, as the vapor density becomes higher, the update basic time CPGTLX becomes larger, thereby extending the update time CPGT of the coefficient KPGT.

Figure 19:
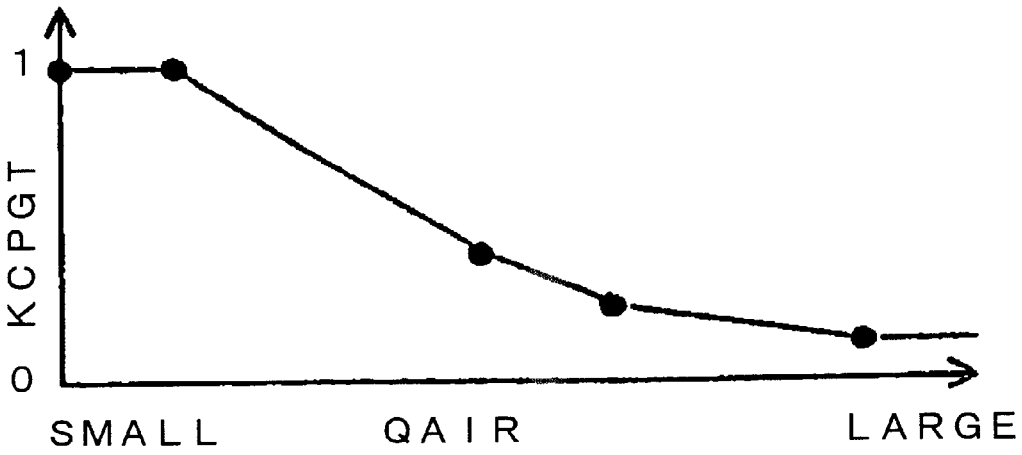
FIG. 19 is an example of a KCPGT table for obtaining a coefficient KCPGT for correcting an update time of a purge flow correction coefficient KPGT based on an intake air amount QAIR according to one embodiment of the invention.

In step 204, a KCPGT table is retrieved based on the intake air amount QAIR to determine a coefficient KCPGT. FIG. 19 shows an example of the KCPGT table. As seen in FIG. 19, the coefficient KCPGT becomes smaller in accordance with the increase of the intake air amount QAIR. Thus, as the intake air amount QAIR becomes smaller, the coefficient KCPGT is larger, thereby extending the update time CPGT of the coefficient KPGT.

In step 205, the update time CPGT is calculated by multiplying the update basic time CPGTLX obtained in step 202 or step 203 by the coefficient KCPGT obtained in step 204. The process proceeds to step 206, in which the counter CCPGT is decremented by one.

At the start of the purge process, the density of the evaporated fuel to be purged is unknown and the value of the counter CCPGT is not zero. Therefore, as shown in step 202, the update time CPGT is controlled by the predetermined value CPGTST. Thereafter, the update time CPGT is set depending on the vapor density coefficient KAFEV and the intake air amount QAIR. Because the influence upon the air-fuel ratio is larger when the vapor density is higher or the intake air amount is less, the update time CPGT is extended so as to more gradually increase the purge flow amount.

Figure 10:
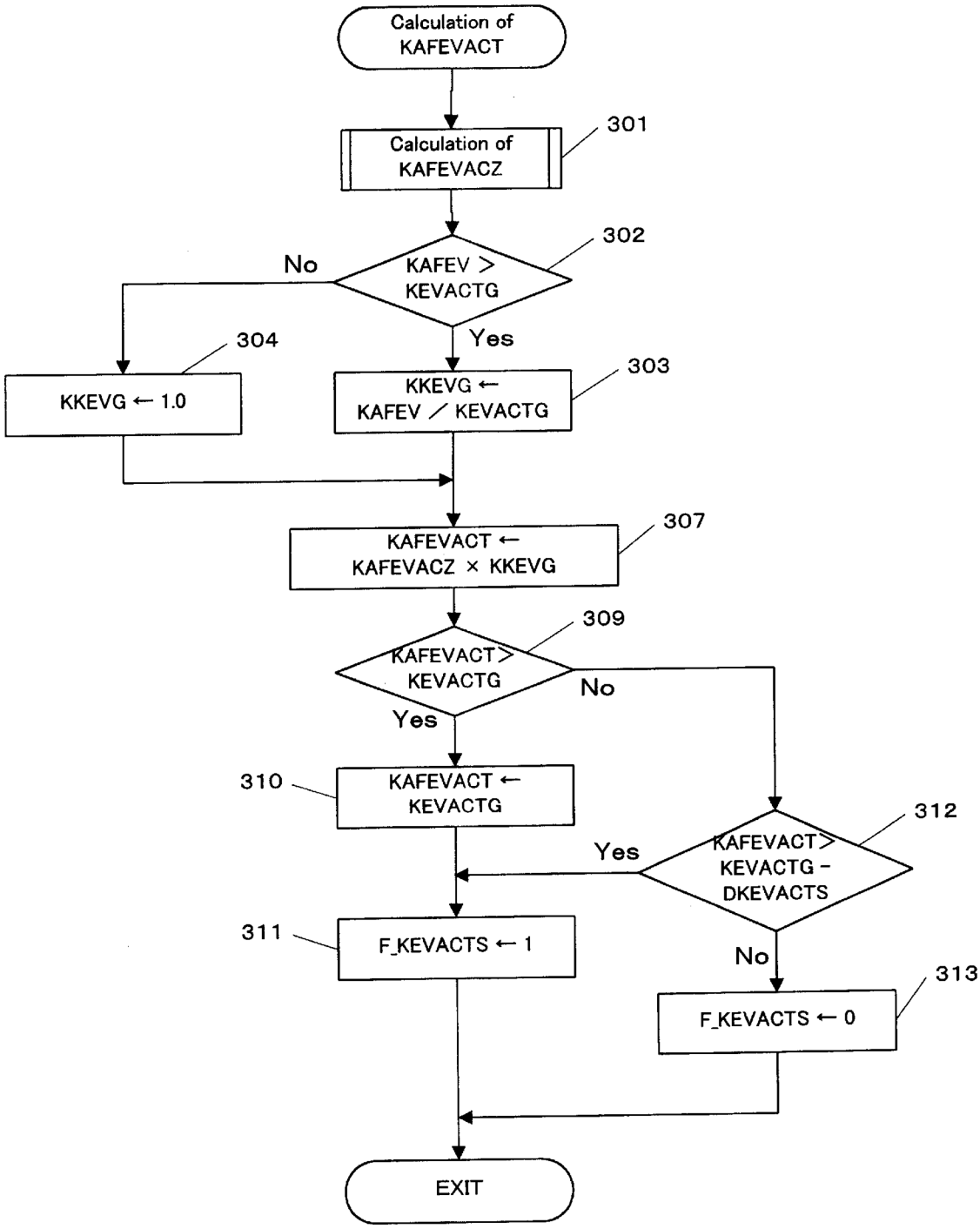
FIG. 10 is a flowchart for determining a purge correction coefficient KAFEVACT according to one embodiment of the invention.

FIG. 10 is a flowchart of a process for determining the purge correction coefficient KAFEVACT. The process is carried out, for example, every time a TDC pulse signal is output from the TDC sensor.

In step 301, a routine (FIG. 11) for determining the target purge correction coefficient KAFEVACZ is carried out. As described above, the target purge correction coefficient KAFEVACZ is a ratio of the evaporated fuel to the required fuel without the correction of the high density correction coefficient KKEVG.

In steps 302 through 304, the high density correction coefficient KKEVG is determined. In step 302, the guard coefficient KEVACTG is compared with the vapor density coefficient KAFEV. If the vapor density coefficient KAFEV is greater than the guard coefficient KEVACTG, it indicates that the density of the evaporated fuel is very high. In this case, "KAFEV/KEVACTG" is calculated to determine the high density coefficient KKEVG in step 303. If the vapor density coefficient KAFEV is equal to or less than the guard coefficient KEVACTG, it indicates that the density of the evaporated fuel is not so high. In this case, the high density correction coefficient KKEVG is set to 1 in step 304.

In step 307, the target purge correction coefficient KAFEVACZ is multiplied by the high density coefficient KKEVG determined in step 303 or step 304 to determine the purge correction coefficient KAFEVACT. In step 309, the determined purge correction coefficient KAFEVACT is compared with the guard coefficient KEVACTG. The guard coefficient KEVACTG is obtained from the map based on the intake manifold pressure PBA and the engine rotational speed NE (Refer to FIG. 11). If the determined purge correction coefficient KAFEVACT is greater than the guard coefficient KEVACTG, the purge correction coefficient KAFEVACT is set to the value of the guard coefficient KEVACTG in step 310 and the flag F_KEVACTS is set to 1 in step 311.

If the determined purge correction coefficient KAFEVACT is greater than the guard coefficient KEVACTG by more than a predetermined value DKEVACTS (for example, 0.05) in step 312, it indicates that the determined purge correction coefficient KAFEVACT has a value which is close to the guard coefficient KEVACTG. In this case, the flag F_KEVACTS is set to 1 in step 311. If the determined purge correction coefficient KAFEVACT is not greater than the guard coefficient KEVACTG by more than the predetermined value DKEVACTS in step 312, the flag F_KEVACTS is set to zero in step 313. Thus, the purge correction coefficient KAFEVACT is controlled not to exceed the guard coefficient KEVACTG. The flag F_KEVACTS is set to 1 when the purge correction coefficient KAFEVACT is close to the guard coefficient KEVACTG.

The flag F_KEVACTS is used in the process (shown in FIG. 8) for determining the purge flow amount coefficient KPGT as described above. If the flag F_KEVACTS is set to 1, it indicates the current fuel correction amount that contributes to the required fuel amount (Refer to FIG. 2) approaches the guard value. Accordingly, the addition operation for the coefficient KPGT is prohibited so that the increase of the purge flow amount is not performed.

Figure 11:
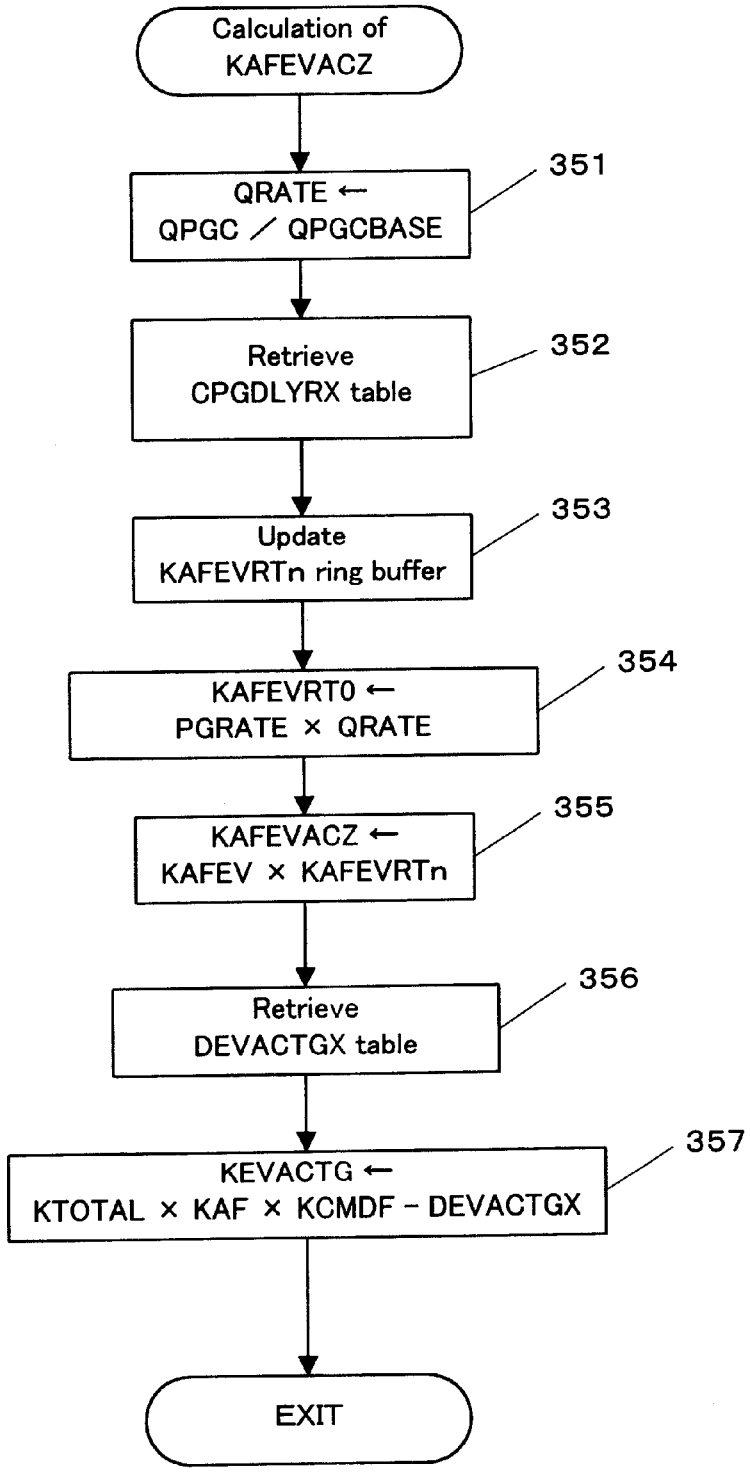
FIG. 11 is a flowchart for determining a target purge correction coefficient KAFEVACZ according to one embodiment of the invention.

FIG. 11 shows a flowchart of a process for determining the target purge correction coefficient KAFEVACZ, which is performed in step 301 of FIG. 10. In steps 351 through 355, the target purge correction coefficient KAFEVACZ is determined in accordance with the above-mentioned equation (12).

Figure 20:
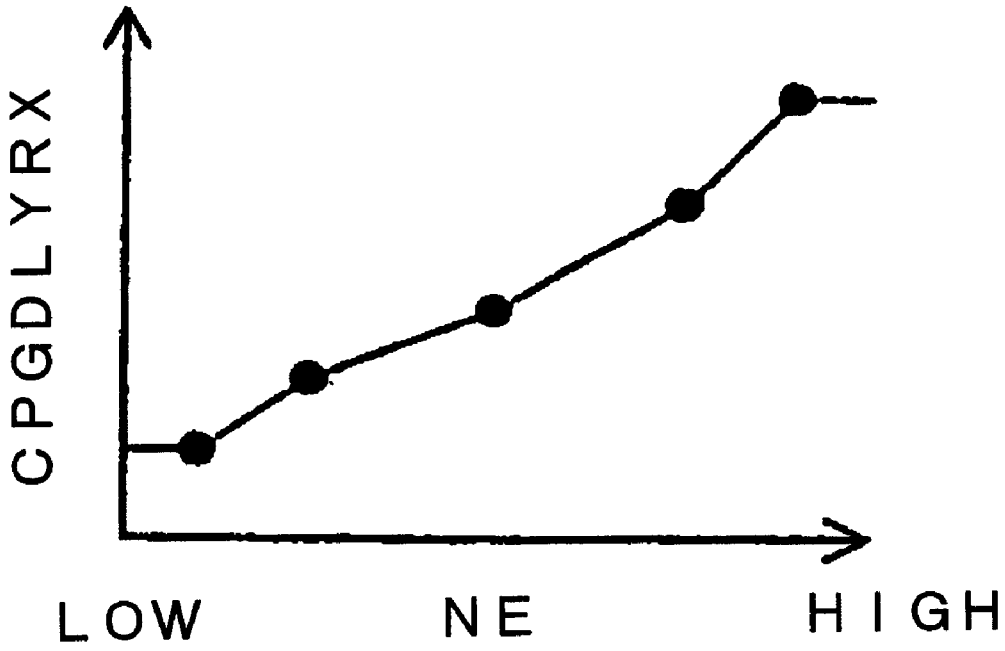
FIG. 20 is an example of a CPGDLYRX table for obtaining a purge transport lag based on an engine rotational speed NE according to one embodiment of the invention.

In step 351, the purge flow amount rate QRATE is determined. This calculation is carried out in accordance with the above-mentioned equation (14). In step 352, a purge transport lag table CPGDLYRX is retrieved based on the engine rotational speed NE to determine the purge transport lag CPGDLYRX. As described above, the purge transport lag CPGDLYRX refers to a time delay between the time at which the evaporated fuel is purged into the purge passage via the purge control valve and the time at which it reaches the intake system of the engine. The purge transport lag CPGDLYRX is represented by an integer n in this embodiment. FIG. 20 shows an example of the purge transport lag table CPGDLYRX. As seen in FIG. 20, the purge transport lag CPGDLYRX increases in proportion to the increase of the rotational speed NE. This is because the number of the intake strokes in the engine carried out during the time period corresponding to the transport lag increases in proportion to the engine rotational speed NE.

In step 353, a ring buffer is shifted by one. The ring buffer consists of, for example, sixteen buffers of KAFEVRT0 through KAFEVRTf. The shift of the ring buffer means that the data stored in KAFEVRT0 through KAFEVRTe are shifted to KAFEVRT1 through KAFEVRTf, respectively. As a result of the shift operation, KAFEVRT0 becomes empty.

In step 354, a value obtained by multiplying the purge flow amount rate QRATE by the duty rate PGRATE that is determined in step 126 of FIG. 6 is stored in the buffer KAFEVRT0. Thus, "PGRATE×QRATE" calculated in the current cycle (k) is stored in the 0th buffer. The values of "PGRATE×QRATE" calculated in the previous cycles (k−1), (k−2), . . . (k−15) are stored in the 1st, 2nd, . . . 15th buffers, namely KAFEVRT1, KAFEVRT2, . . . KAFEVRTf, respectively.

In step 355, the vapor density coefficient KAFEV is multiplied by the value stored in KAFEVRTn corresponding to the value n of the purge transport lag determined in step 352, so as to determine the target purge correction coefficient KAFEVACZ. For example, when the purge transport lag CPGDLYRX is "4", the value stored in the buffer KAFEVRT4 is used.

In steps 356 and 357, the guard coefficient KEVACTG is determined. In step 356, a DEVACTGX map is retrieved based on the intake manifold pressure PBA and the rotational speed NE to determine the delta coefficient DEVACTGX. The delta coefficient DEVACTGX has been described above with reference to FIG. 2. In step 357, the guard coefficient KEVACTG is determined in accordance with the above-mentioned equation (4).

Figure 12:
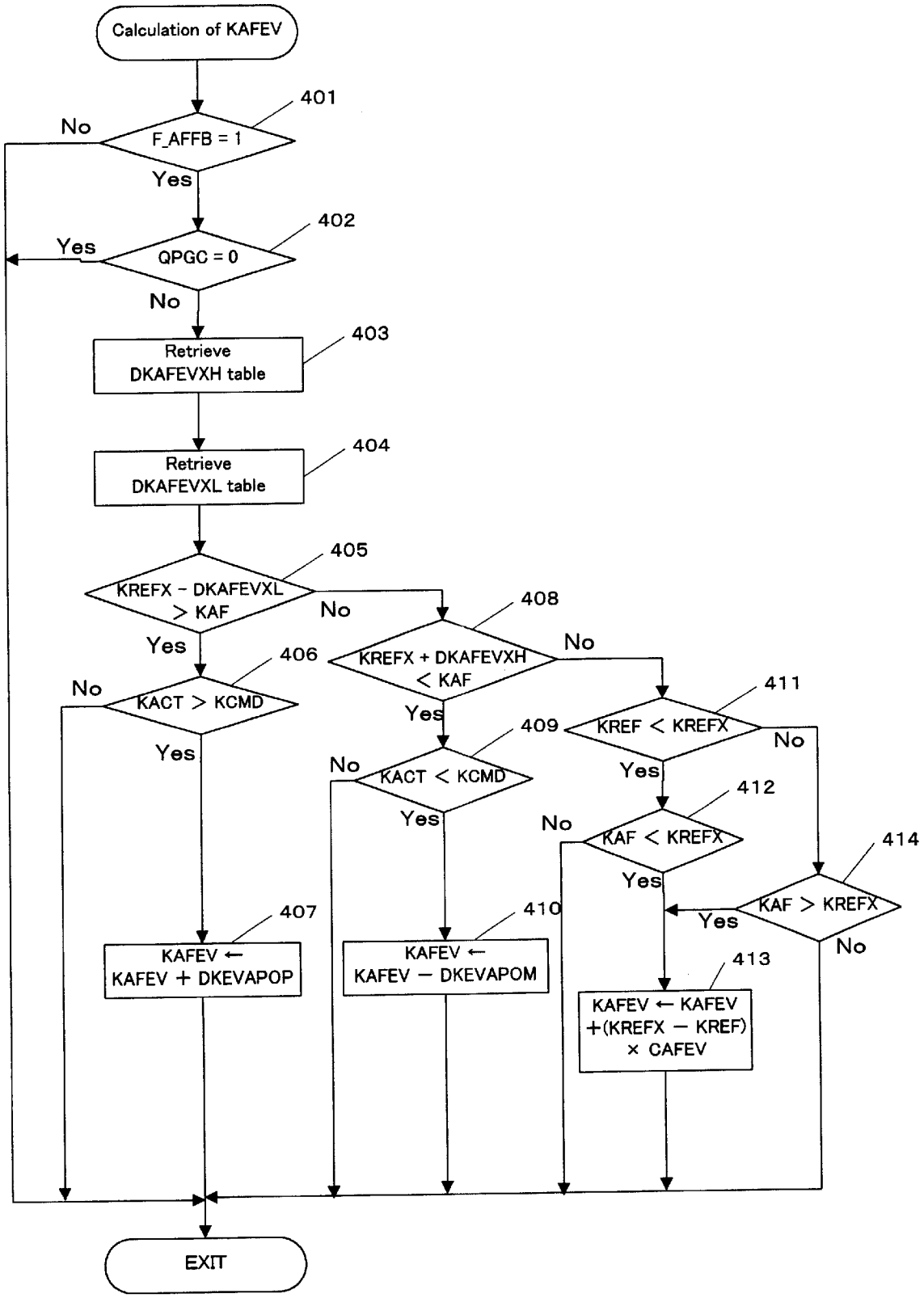
FIG. 12 is a flowchart for determining a vapor density coefficient KAFEV according to one embodiment of the invention.

FIG. 12 is a flowchart of a process for determining the vapor density coefficient KAFEV. The process is performed repeatedly at predetermined intervals (for example, ten milliseconds).

In step 401, the value of a flag F_AFFB is examined. The flag is set to 1 when the air-fuel feedback control is being executed. When the value of the flag F_AFFB is zero, the process exits the routine. When the value of the flag F_AFFB is 1, the process proceeds to step 402. In step 402, when the purge flow amount QPGC is zero, the process exits the routine because it indicates that the evaporated fuel is not purged in the current cycle. When the purge flow amount QPGC is not zero, the process proceeds to step 403.

Figure 21:
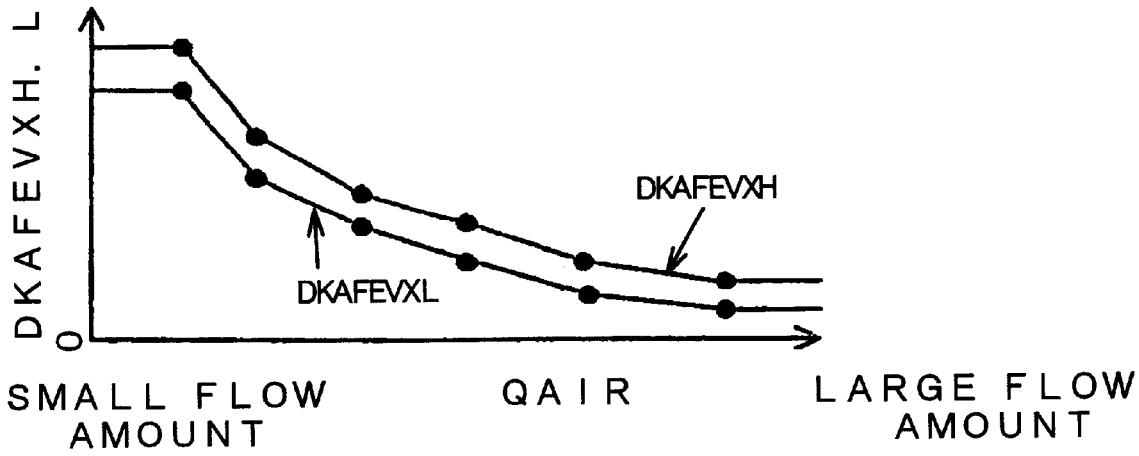
FIG. 21 is an example of a DKAFEVXH table and a DKAFEVXL table for obtaining a higher and a lower determination values DKAFEVXH and DKAFEVXL, respectively, based on an intake air amount QAIR according to one embodiment of the invention.

In steps 403 and 404, a DKAFEVXH table and a DKAFEVXL table are retrieved based on the intake air amount QAIR to determine a higher determination value DKAFEVXH and a lower determination value DKAFEVXL, respectively. FIG. 21 shows examples of the tables. The higher determination value DKAFEVXH and the lower determination value DKAFEVXL decrease in accordance with the increase of the intake air amount QAIR.

When a difference between an air-fuel ratio learned value KREFX and the lower determination value DKAFEVXL is greater than the air-fuel ratio feedback coefficient KAF in step 405 and the actual air-fuel ratio coefficient KACT is greater than the target air-fuel ratio coefficient KCMD in step 406, it indicates the air-fuel ratio is rich under the influence of purge. Therefore, the vapor density coefficient KAFEV is incremented by a predetermined value DKEVAPOP (for example, 0.05) in step 407. The air-fuel ratio learned value KREFX is an average of the air-fuel ratio feedback coefficients KAF while a purge cut process is being performed.

On the other hand, when a value obtained by adding the higher determination value DKAFEVXH to the air-fuel ratio learned value KREFX is less than the air-fuel ratio feedback coefficient KAF in step 408 and the actual air-fuel ratio KACT is less than the target air-fuel ratio KCMD in step 409, it indicates that the air-fuel ratio is lean. Therefore, the vapor density coefficient KAFEV is decremented by a predetermined value DKEVAPOM (for example, 0.08) in step 410.

When both decisions in steps 405 and 408 are "No", it indicates that the air-fuel ratio feedback coefficient KAF is between the higher determination value DKAFEVXH and the lower determination value DKAFEVXL. In this case, the vapor density coefficient KAFEV is determined in accordance with a difference between the learned values KREF and KREFX in the steps 411 through 414. The learned value KREF is an average of the air-fuel ratio feedback coefficients KAF while the air-fuel feedback control is being performed. The learned value KREF is measured regardless of the execution of the purge process.

When the learned value KREF is less than the learned value KREFX in step 411, the process proceeds to step 412. When the learned value KREF is equal to or greater than the learned value KREFX, it proceeds to step 414.

In step 412, when the air-fuel feedback coefficient KAF is less than the learned value KREFX, it indicates that the air-fuel ratio is close to rich under the influence of purge. A value obtained by subtracting the learned value KREF from the learned value KREFX is multiplied by a predetermined value CAFEV (for example, 0.02). The resultant value is added to the current vapor density coefficient KAFEV. Thus, the vapor density coefficient KAFEV is updated. In this case, the vapor density coefficient KAFEV increases because KREFX is greater than KREF.

On the other hand, in step 414, when the air-fuel feedback coefficient KAF is greater than the learned value KREFX, it indicates that the air-fuel ratio is close to lean. A value obtained by subtracting the learned value KREF from the learned value KREFX is multiplied by the predetermined value CAFEV. The resultant value is added to the current vapor density coefficient KAFEV. Thus, the vapor density coefficient KAFEV is updated. In this case, the vapor density coefficient KAFEV decreases because KREF is greater than KREFX.

What is claimed is:

1. An evaporated fuel controller for an internal-combustion engine comprising a purge system for purging evaporated fuel generated inside a fuel tank to an intake system of the engine through a purge control valve, the controller being configured to:

determine a guard value that is an upper limit of the evaporated fuel in accordance with driving conditions of the engine; and control the purge control valve to prevent an amount of the evaporated fuel from exceeding the guard value.

2. The evaporated fuel controller of claim 1, wherein the guard value is the upper limit of the evaporated fuel able to be included in a required fuel to be supplied to the engine.

3. The evaporated fuel controller of claim 1, wherein the guard value is determined based on a rotational speed of the engine and an intake manifold pressure of the engine.

4. The evaporated fuel controller of claim 1, further configured to:

determine a transport lag of the evaporated fuel between the purge control valve and the engine; and determine an evaporated fuel amount purged a time period earlier, the time period corresponding to the transport lag, wherein the purge control valve is controlled based on the evaporated fuel amount purged the time period earlier.

5. The evaporated fuel controller of claim 4, wherein the purge control valve is controlled to prevent the amount of the evaporated fuel from increasing if the evaporated fuel amount purged the time period earlier is close to the guard value.

6. The evaporated fuel controller of claim 4, wherein the time period corresponding to the transport lag is determined based on a rotational speed of the engine.

7. The evaporated fuel controller of claim 1, wherein the purge control valve is further controlled so that a maximum amount of the evaporated fuel is purged as long as the amount of to the evaporated fuel does not exceed the guard value.

8. The evaporated fuel controller of claim 1, further configured to determine a density of the evaporated fuel, wherein the amount of the evaporated fuel is determined based on the density of the evaporated fuel.

9. The evaporated fuel controller of claim 1, wherein the amount of the evaporated fuel is further determined based on an intake air amount taken from an intake manifold in the intake system.

10. The evaporated fuel controller of claim 1, further comprising a fuel supply system for supplying fuel from the fuel tank to the engine through a fuel injection valve, wherein the controller is further configured to:

determine an amount of the required fuel in accordance with the driving conditions of the engine;

correct the required fuel amount with a fuel correction amount corresponding to the amount of the evaporated fuel, the amount of the evaporated fuel being controlled not to exceed the guard value; and control the fuel injection valve to inject the corrected required fuel amount.

11. A method for controlling an amount of evaporated fuel to be purged to an intake system of an engine, the method comprising:

(a) determining a guard value that is an upper limit of the evaporated fuel in accordance with driving conditions of the engine; and (b) controlling a purge control valve to prevent an amount of the evaporated fuel from exceeding the guard value, the purge control valve being provided in a passage connected to the intake system.

12. The method of claim 11, wherein the step (b) further comprises:

(b1) determining a transport lag between a time when the evaporated fuel is purged and a time when the evaporated fuel reaches the engine;

(b2) determining an evaporated fuel amount purged a time period earlier, the time period corresponding to the transport lag; and (b3) controlling the purge control valve to prevent the amount of the evaporated fuel from increasing if the evaporated fuel amount purged the time period earlier is close to the guard value.

13. The method of claim 12, further comprising gradually increasing the evaporated fuel, wherein the step (b3) further comprises prohibiting the increase of the evaporated fuel if the evaporated fuel amount purged the time period earlier is close to the guard value.

14. The method of claim 12, wherein the step (b3) further comprises controlling the purge control valve to limit the amount of the evaporated fuel to the guard value if the evaporated fuel amount purged the time period earlier exceeds the guard value.

15. The method of claim 11, further comprising:

determining a density of the evaporated fuel; and determining a purge flow amount flowing through the purge control valve, wherein the amount of the evaporated fuel is determined based on the density of the evaporated fuel and the purge flow amount.

16. The method of claim 11, further comprising:

determining an amount of the required fuel in accordance with the driving conditions of the engine;

correcting the required fuel amount with a fuel correction amount corresponding to the amount of the evaporated fuel, the amount of the evaporated fuel being controlled not to exceed the guard value; and controlling a fuel injection valve to inject the corrected required fuel amount to the engine.

17. The method of claim 16, wherein the step of correcting the required fuel amount further comprises subtracting the fuel correction amount from the required fuel amount to determine the corrected required fuel amount.

18. A computer-readable medium including a computer program executable on a computer system for controlling an amount of evaporated fuel to be purged to an intake system of the engine, the computer program performing:

(a) determining a guard value that is an upper limit of the evaporated fuel in accordance with driving conditions of the engine; and (b) generating a parameter for controlling a purge control valve to prevent an amount of the evaporated fuel from exceeding the guard value, the purge control valve being provided in a passage connected to the intake system.

19. The computer-readable medium of claim 18, wherein the step (b) further performs:

determining a transport lag fuel between a time when the evaporated fuel is purged and a time when the evaporated fuel reaches the engine;

determining an evaporated fuel amount purged a time period earlier, the time period corresponding to the transport lag;

generating the parameter for controlling the purge control valve to prevent the amount of the evaporated fuel from increasing if the evaporated fuel amount purged a time period earlier is close to the guard value.

20. The computer-readable medium of claim 17, the computer program further performing:

determining an amount of the required fuel in accordance with the driving conditions of the engine; and correcting the required fuel amount with a fuel correction amount corresponding to the amount of the evaporated fuel, the amount of the evaporated fuel being controlled not to exceed the guard value; and controlling a fuel injection valve to inject the corrected required fuel amount to the engine.

* * * * *